US007040424B2

(12) United States Patent
Yong et al.

(10) Patent No.: US 7,040,424 B2
(45) Date of Patent: May 9, 2006

(54) DRILL BIT AND CUTTER HAVING INSERT CLUSTERS AND METHOD OF MANUFACTURE

(75) Inventors: Zhou Yong, Spring, TX (US); Peter M. Davies, Ponca City, OK (US); Hubert W. Penka, Jr., Ponca City, OK (US); Ernest L. Buford, Ponca City, OK (US)

(73) Assignee: Smith International, Inc., Houston, TX (US)

( * ) Notice: Subject to any disclaimer, the term of this patent is extended or adjusted under 35 U.S.C. 154(b) by 139 days.

(21) Appl. No.: 10/379,015

(22) Filed: Mar. 4, 2003

(65) Prior Publication Data

US 2004/0173384 A1 Sep. 9, 2004

(51) Int. Cl.
*E21B 10/16* (2006.01)

(52) U.S. Cl. ..... 175/374; 175/378; 175/426; 175/432

(58) Field of Classification Search ..... 175/426, 175/425, 432, 374, 378, 375
See application file for complete search history.

(56) References Cited

U.S. PATENT DOCUMENTS

| | | | | |
|---|---|---|---|---|
| 3,442,352 A | | 5/1969 | McElya et al. | |
| 4,056,153 A | | 11/1977 | Miglierini | |
| 4,058,177 A | | 11/1977 | Langford, Jr. et al. | |
| 4,086,973 A | | 5/1978 | Keller et al. | |
| 4,108,260 A | | 8/1978 | Bozarth | |
| 4,271,917 A | * | 6/1981 | Sahley | 175/426 |
| 4,334,586 A | | 6/1982 | Schumacher | |
| 4,716,977 A | | 1/1988 | Huffstutler | |
| 4,722,405 A | * | 2/1988 | Langford, Jr. | 175/374 |
| 4,811,801 A | * | 3/1989 | Salesky et al. | 175/433 |
| 4,832,139 A | | 5/1989 | Minikus et al. | |
| 4,854,405 A | * | 8/1989 | Stroud | 175/374 |
| 4,951,762 A | | 8/1990 | Lundell | |

(Continued)

FOREIGN PATENT DOCUMENTS

EP 0 527 506 A2 2/1993

(Continued)

OTHER PUBLICATIONS

Search Report for Appln. No. GB0404709.8, dated Mar. 25, 2004; (1 p.).

(Continued)

*Primary Examiner*—David Bagnell
*Assistant Examiner*—G M Collins
(74) *Attorney, Agent, or Firm*—Conley Rose, P.C.

(57) ABSTRACT

Disclosed is a rolling cone cutter and drill bit employing multiple inserts retained as a cluster in an aperture in the cone cutter. Apertures in which the insert clusters are retained are multilobed apertures formed by intersecting bores formed in the cone steel. The apertures may also be created by forming spaced apart bores and milling regions of the cone steel that extends between the bores. The inserts in a cluster may be retained within the aperture to differing depths, may extend above the cone steel to differing extension lengths, and may have cutting portions having a variety of shapes. The inserts in a cluster may be made of different materials in order to optimize cutting duty. The bores forming the multilobed aperture may be parallel or skewed, and may create an aperture having a multilevel bottom surface so as to permit the insertion of an insert having a relatively large cutting surface in instances when the cone design would not otherwise permit the use of a cylindrical insert of the desired diameter.

62 Claims, 9 Drawing Sheets

U.S. PATENT DOCUMENTS 5,172,777 A 12/1992 Siracki et al.
5,172,779 A 12/1992 Siracki et al.
5,197,555 A 3/1993 Estes
5,201,376 A 4/1993 Williams
5,322,138 A 6/1994 Siracki
5,323,865 A 6/1994 Isbell et al.
5,341,890 A 8/1994 Cawthorne et al.
5,351,768 A 10/1994 Scott et al.
5,372,210 A 12/1994 Harrell
5,407,022 A 4/1995 Scott et al.
5,415,244 A 5/1995 Portwood
5,421,423 A * 6/1995 Huffstutler ..... 175/374
5,421,424 A 6/1995 Portwood et al.
5,429,200 A 7/1995 Blackman et al.
5,452,771 A 9/1995 Blackman et al.
5,479,997 A 1/1996 Scott et al.
5,518,077 A 5/1996 Blackman et al.
5,533,582 A * 7/1996 Tibbitts ..... 175/430
5,542,485 A 8/1996 Pessier et al.
5,592,995 A 1/1997 Scott et al.
5,636,700 A 6/1997 Shamburger, Jr.
5,644,956 A 7/1997 Blackman et al.
5,695,019 A 12/1997 Shamburger, Jr.
5,697,462 A 12/1997 Grimes et al.
5,709,278 A 1/1998 Crawford
5,746,280 A 5/1998 Scott et al.
5,752,573 A 5/1998 Scott et al.
5,755,301 A 5/1998 Love et al.
5,813,485 A 9/1998 Portwood
5,819,861 A 10/1998 Scott et al.
5,833,020 A 11/1998 Portwood et al.
5,839,526 A 11/1998 Cisneros et al.
5,881,828 A 3/1999 Fischer et al.
5,887,655 A 3/1999 Haugen et al.
5,887,668 A 3/1999 Haugen et al.
5,890,550 A 4/1999 Swadi et al.
5,915,486 A 6/1999 Portwood et al.
5,967,245 A 10/1999 Garcia et al.
6,029,759 A 2/2000 Sue et al.
6,053,263 A 4/2000 Meiners
6,059,054 A 5/2000 Portwood et al.
6,161,634 A * 12/2000 Minikus et al. ..... 175/331
6,202,752 B1 3/2001 Kuck et al.
6,241,034 B1 6/2001 Steinke et al.
6,427,791 B1 * 8/2002 Glowka et al. ..... 175/413
6,530,441 B1 * 3/2003 Singh et al. ..... 175/431
6,745,645 B1 6/2004 Griffo

FOREIGN PATENT DOCUMENTS

GB 2398330 A 8/2004
WO WO 01/61142 A1 8/2001

OTHER PUBLICATIONS

Search Report for Appln. No. GB0404709.8, dated Sep. 23, 2004; (1 p.).

* cited by examiner

DRILL BIT AND CUTTER HAVING INSERT CLUSTERS AND METHOD OF MANUFACTURE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The invention relates generally to earth-boring bits used to drill a borehole for the ultimate recovery of oil, gas or minerals. More particularly, the invention relates to rolling cone rock bits and to an improved cutting structure for such bits. Still more particularly, the invention relates to enhancements in cutter elements and in manufacturing techniques for cutter elements, rolling cone cutters and drill bits.

2. Description of the Related Art

An earth-boring drill bit is typically mounted on the lower end of a drill string and is rotated by revolving the drill string at the surface or by actuation of downhole motors or turbines, or by both methods. With weight applied to the drill string, the rotating drill bit engages the earthen formation and proceeds to form a borehole along a predetermined path toward a target zone. The borehole formed in the drilling process will have a diameter generally equal to the diameter or "gage" of the drill bit.

A typical earth-boring bit includes one or more rotatable cone cutters that perform their cutting function due to the rolling movement of the cone cutters acting against the formation material. The cone cutters roll and slide upon the bottom of the borehole as the bit is rotated, the cone cutters thereby engaging and disintegrating the formation material in its path. The rotatable cone cutters may be described as generally conical in shape and are therefore referred to as rolling cones.

Rolling cone bits typically include a bit body with a plurality of journal segment legs. The rolling cones are mounted on bearing pin shafts that extend downwardly and inwardly from the journal segment legs. The borehole is formed as the gouging and scraping or crushing and chipping action of the rotary cones remove chips of formation material which are carried upward and out of the borehole by drilling fluid which is pumped downwardly through the drill pipe and out of the bit.

The earth disintegrating action of the cone cutters is enhanced by providing the cone cutters with a plurality of cutter elements. Cutter elements are generally of two types: inserts formed of a very hard material, such as tungsten carbide, that are typically press fit into undersized apertures in the cone surface; or teeth that are milled, cast or otherwise integrally formed from the material of the rolling cone. Bits having tungsten carbide inserts are typically referred to as "TCI" bits, while those having teeth formed from the cone material are commonly known as "steel tooth bits." In each instance, the cutter elements on the rotating cone cutters breakup the formation to form new borehole by a combination of gouging and scraping or chipping and crushing.

In oil and gas drilling, the cost of drilling a borehole is proportional to the length of time it takes to drill to the desired depth and location. The time required to drill the well, in turn, is greatly affected by the number of times the drill bit must be changed in order to reach the targeted formation. This is the case because each time the bit is changed, the entire string of drill pipes, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer, and which are usable over a wider range of formation hardness.

The length of time that a drill bit may be employed before it must be changed depends upon its ability to "hold gage" (meaning its ability to maintain a full gage borehole diameter), its rate of penetration ("ROP"), as well as its durability or ability to maintain an acceptable ROP. The form and positioning of the cutter elements in the cone cutters greatly impact bit durability and ROP and thus, are critical to the success of a particular bit design.

The inserts in TCI bits are typically inserted in circumferential rows on the rolling cone cutters. Most such bits include a row of inserts in the heel surface of the cone cutters. The heel surface is a generally frustoconical surface and is configured and positioned so as to align generally with and ream the sidewall of the borehole as the bit rotates. In addition to the heel row inserts, conventional bits typically include a circumferential gage row of cutter elements mounted adjacent to the heel surface but oriented and sized so as to cut the corner of the borehole. Conventional TCI bits also include a number of additional rows of cutter elements that are positioned in circumferential rows disposed radially inward or in board from the gage row. These cutter elements are sized and configured for cutting the bottom of the borehole, and are typically described as inner row cutter elements.

A variety of different shapes of cutter elements have been devised. In most instances, each cutter element is designed to optimize the amount of formation material that is removed with each "hit" of the formation by the cutter element. At the same time, however, the size, shape and design of a particular cutter element is also dependent upon, and many times compromised by, factors such as the location in the drill bit in which it is to be placed, the type of formation, and the element's vulnerability to the forces expected to be encountered.

TCI inserts generally include a cylindrical barrel or base portion that is embedded and retained within a cylindrical hole or bore formed in the cone steel, and a cutting portion that extends above the cone steel for engaging the formation material. To retain an insert in the cone, a predetermined barrel length is typically required for a given diameter and length of insert. In certain bit designs, and at particular locations on the rolling cone, it may be desirable to provide an insert having a cutting portion with a relatively large cutting surface so as to enhance the removal of the formation material at the locations where that cutter element insert engages the formation. Unfortunately, it is many times impossible to provide an insert with the cutting portion of the desired size due to limitations in the core steel available for retaining the insert's base. More particularly, bores formed in the cone steel for retaining other inserts in the same row, as well as bores retaining inserts in other rows in the cone, limit the depth and diameter of a given hole. The various adjacent holes must be separated to the extent such that the steel in the region has sufficient strength to retain the insert when it undergoes the extreme forces imparted by the formation as the bit is rotated in the borehole, such forces including both impact forces and forces tending to bend or rotate the insert. In short, the limited volume of cone steel available for receiving and retaining the base portion of inserts has typically limited the size and shape of the cutting portion of the insert. Accordingly, in order to design a bit that produced acceptable ROP and reasonable durability, compromises had to be made in the size and shape of the inserts.

In an attempt to provide a larger cutting portion, certain conventional inserts have been made that extended beyond the footprint or envelope of the base portion of the insert. Examples of such inserts include those described as being formed with a negative draft as shown in U.S. Pat. No. 6,241,034, incorporated herein by reference. While providing the advantage of an increased cutting surface area, as compared to other conventional inserts, such inserts are more expensive to manufacture and are difficult to secure in the cone in a way that prevents rotation of the insert and misalignment of the cutting portion with the desired orientation.

In U.S. Pat. No. 5,421,423, incorporated herein by reference, inserts having elongate cutting portions and correspondingly-shaped elongate base portions are disclosed. Such inserts are described as being press fit into elongate slot-shaped sockets formed in the cone steel, where such slots are formed by boring spaced apart holes in the cone steel and then milling the steel between the two bores to form a slot having the same width as the diameter of the bores. This method of forming the slotted socket thus requires machining that, relative to merely boring holes into the cone steel, is more time consuming, expensive, and exacting. Providing a slot-like socket capable of retaining the elongate, non-circular insert by interference fit is difficult to achieve.

Accordingly, to provide a drill bit with higher ROP and better durability, and thus to lower the drilling costs incurred in the recovery of oil and other valuable resources, it would be desirable to provide cutter elements having desirably shaped and sized cutting portions that have larger cutting surfaces than those that can be retained in a conventional aperture. Further, it would be advantageous that such cutter elements resist the rotation and movement within the aperture and be retained in the cone steel even in instances where the cone steel is limited in both cone surface area and depth of permissible bore. Preferably, such cutter elements and the methods for manufacturing cone cutters and bits would provide a bit that will retain cutting inserts and protect the cone steel for longer periods than conventional methods and apparatus so as to yield improved ROPs and an increase in footage drilled.

SUMMARY OF EXEMPLARY PREFERRED EMBODIMENTS

Preferred embodiments are disclosed for drill bits or other drilling apparatus with enhancements in cutter element design and in manufacturing methods that provide the potential for enhancing bit ROP and increased bit life. The embodiments disclosed include a drill bit including at least one rolling cone cutter, the cutter including an aperture and a cluster of discrete cutting inserts secured together in the same aperture. The cluster of cutting inserts may include two, three, or a larger number of inserts. The inserts in a cluster may have differing sizes and shapes and may be embedded within the cone steel to differing depths and extend beyond the cone steel to differing heights. Likewise, the inserts in a cluster may be made of, or coated with, materials that differ in hardness, wear resistance and toughness, so as to particularly tailor the inserts of the cluster to optimally perform and best withstand the type of cutting duty that the insert will experience. Thus, for example, the inserts may be made from different grades of tungsten carbide, or certain inserts may have cutting surfaces coated with diamond or other super abrasive materials. In certain embodiments, an interface between contacting inserts in a cluster are formed, such interfaces including substantially planar engaging surfaces, and a curved surface on a first insert nesting within a correspondingly curved surface of a second insert. The interface surfaces of the inserts in a cluster may include means to resist relative movement of the inserts, including providing intermeshing extensions on contacting surfaces, or providing a generally cylindrical locking insert that is retained in curved recesses of inserts that surround the locking insert.

The aperture retaining the cluster of inserts is preferably a multilobed aperture. The aperture may be formed by forming intersecting bores into the cone steel such that the multilobed aperture is formed having a neck portion of reduced width disposed between the lobes. The bores forming the multilobed aperture may be formed parallel to one another or skewed and, likewise, may be generally perpendicular or not perpendicular to the cone surface in which they are formed. Varying the depth of bores, as well selecting appropriate angles for the bores, permits forming an aperture and retaining a cluster of inserts that may provide a cutting surface of desired surface area and shape that would not otherwise be possible due to space limitations within the cone steel.

Disclosed also are methods of manufacturing cutters and drill bits including the method of providing a cutter, forming a first bore into the outer surface of the cutter, forming a second bore into the outer surface of the cutter that intersects with the first bore so as to form a multilobed aperture, and inserting at least one cutting insert into the multilobed aperture. In a particular embodiment of this method, the method includes inserting a plurality of cutting inserts into the multilobed aperture. The method may also include forming particular interface surfaces on the inserts of the cluster, engaging the interface surfaces, and inserting the cutting inserts of the cluster into the aperture.

Also disclosed is a method and apparatus including a handling template for retaining cutting inserts in a cluster, positioning the cluster above an aperture formed in the cutter, and pressing the insert cluster into the aperture.

As described, the insert clusters may be pressed into the formed aperture and retained therein by interference fit. Alternatively, the insert clusters may be welded, brazed, adhesively secured or otherwise retained within an aperture.

The insert clusters may be employed in the cutting surfaces of bits that do not employ rolling cones, such as drag bits. Also, the insert clusters described herein may be inserted in various locations on the bit body, such as in the shirttail or adjacent to ports, nozzles and other features where resistance to erosion and abrasion is desired.

The inserts in a cluster may be first formed by conventional process, such as HIP, in cylindrical shape, and with the desired interface surface thereafter being ground or otherwise machined or formed on the inserts. Alternatively, the inserts of a cluster, with the desired interface surface, may be formed in a single manufacturing step. Similarly, a single, multilobed insert may be formed via a conventional manufacturing process, with the multilobed insert then press fit or otherwise secured within the multilobed aperture formed in the cone steel.

The bits, rolling cone cutters, and insert clusters described herein provide opportunities for improvements in bit ROP and durability. In part, such opportunities are presented due to the ability to provide a relatively large cutting surface area provided by insert cluster without also requiring a correspondingly large socket that, in conventional bits employing conventional inserts may not be possible due to an insufficient volume of cone material between the socket and the sockets retaining adjacent inserts. Further, where employed, the use of different materials for different inserts within a cluster potentially offers enhanced ROP and longer bit life. These and various other characteristics and advantages potentially offered by the embodiments described herein will be readily apparent to those skilled in the art upon reading the following detailed description of the preferred embodiments, and by referring to the accompanying drawings.

BRIEF DESCRIPTION OF THE DRAWINGS

For a more detailed description of the preferred embodiments of the present invention, reference will now be made to the accompanying drawings, wherein.

DETAILED DESCRIPTION OF PREFERRED EMBODIMENTS

Figure 1:
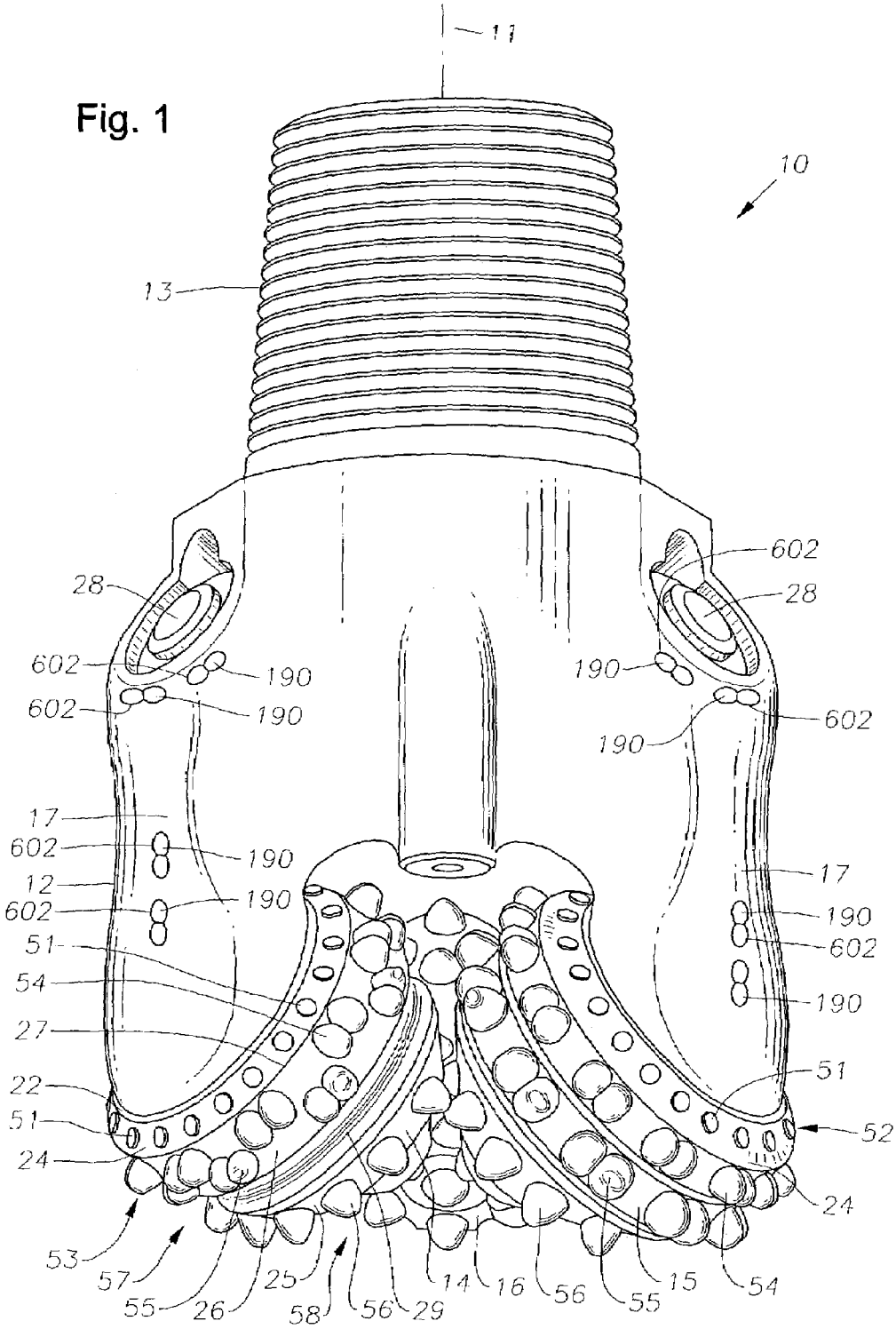
FIG. 1 is a perspective view of an earth boring bit having insert clusters retained in rolling cone cutters.

Referring first to FIG. 1, an earth-boring bit 10 includes a central axis 11 and a bit body 12 having a threaded section 13 on its upper end for securing the bit to the drill string (not shown). Bit 10 has a predetermined gage diameter as defined by three rolling cone cutters 14, 15, 16 rotatably mounted on bearing shafts (not shown) that depend from the bit body 12. The concepts presented herein will be understood with a detailed description of one such cone cutter 14, with cones 15, 16 being similarly, although not necessarily identically, configured. Bit body 12 is composed of three sections, or legs 17 (two shown in FIG. 1), that are joined together to form bit body 12.

Figure 2:
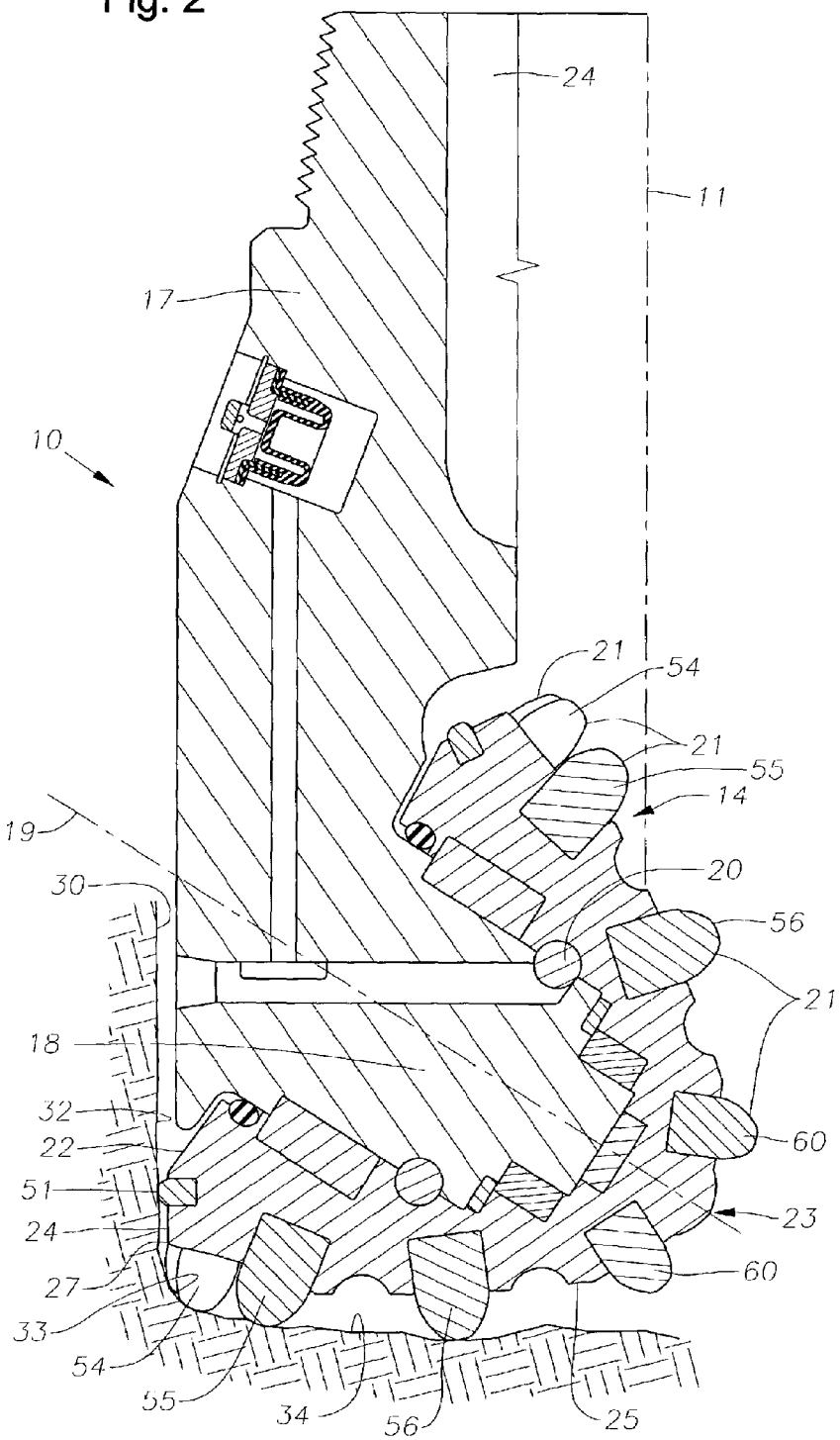
FIG. 2 is a partial section view taken through one leg and one rolling cone cutter of the bit shown in FIG. 1.

Referring now to FIG. 2, bit 10 is shown inside a borehole 30 that includes sidewall 32, corner portion 33 and bottom 34. Cone cutter 14 is rotatably mounted on a pin or journal 18, with an axis of rotation 19 oriented generally downward and inward towards the center of bit 10. Cone cutter 14 is secured on pin 18 by ball bearings 20. Cutters 14–16 include a plurality of tooth-like cutter elements 21, for gouging and chipping away the formation material and enhancing the formation of the borehole.

Referring still to FIGS. 1 and 2, each cone cutter 14–16 includes a backface 22 and nose portion 23 generally opposite backface 22. Adjacent to backface 22, cutters 14–16 further include a frustoconical heel surface 24 that is adapted to retain cutter elements that scrape or ream sidewall 32 of the borehole as cutters 14–16 rotate about borehole bottom 34. Frustoconical surface 24 is referred to herein as the "heel" surface of cutters 14–16, it being understood, however, that the same surface may be sometimes referred to by others in the art as the "gage" surface of a rolling cone cutter. Extending between heel surface 24 and nose 23 is a generally conical surface 25 adapted for supporting cutter elements which gouge or crush the borehole bottom 34 as the cone cutters 14–16 rotate about the borehole.

Referring back to FIG. 1, conical surface 25 typically includes a plurality of generally frustoconical segments 26, generally referred to as "lands," which are separated by grooves 29. Lands 26 are employed to support and secure cutter elements 21. Frustoconical heel surface 24 and conical surface 25 converge in a circumferential edge or shoulder 27. Cutter elements 21 retained in cone cutter 14 include a plurality of heel row cutter elements 51 that are secured in a circumferential row 52 in the heel surface 24. Cone cutter 14 further includes a circumferential row 53 of gage cutter elements 54 secured to cone cutter 14 in locations along or near the circumferential shoulder 27. Cone cutter 14 further includes a plurality of inner row cutter elements, such as cutter elements 55 and 56 secured to conical surface 25 and arranged in spaced-apart inner rows 57 and 58, respectively.

Referring again to FIG. 2, heel row cutter elements 51 generally function to scrape or ream the borehole sidewall 32 to maintain the borehole at full gage and prevent erosion and abrasion of heel surface 24. Gage row cutter elements 54 generally serve to cut the borehole corner 33. Cutter elements 55 and 56 of inner rows 57 and 58 are employed primarily to gouge and crush and thereby remove formation material from the borehole bottom 34. Inner rows 57 and 58, are arranged and spaced on cone cutter 14 so as not to interfere with the inner rows on each of the other cone cutters 15–16.

In the embodiment shown in FIGS. 1 and 2, each cone cutter 14–16 includes at least one cutting element on nose portion 23 spaced radially inward from inner rows 57 and 58, herein referred to as a nose row cutter element 60. As cone cutters 14–16 rotate about their respective axes 19, nose cutter elements 60 gouge and remove the central or core portion of the borehole.

Figure 3:
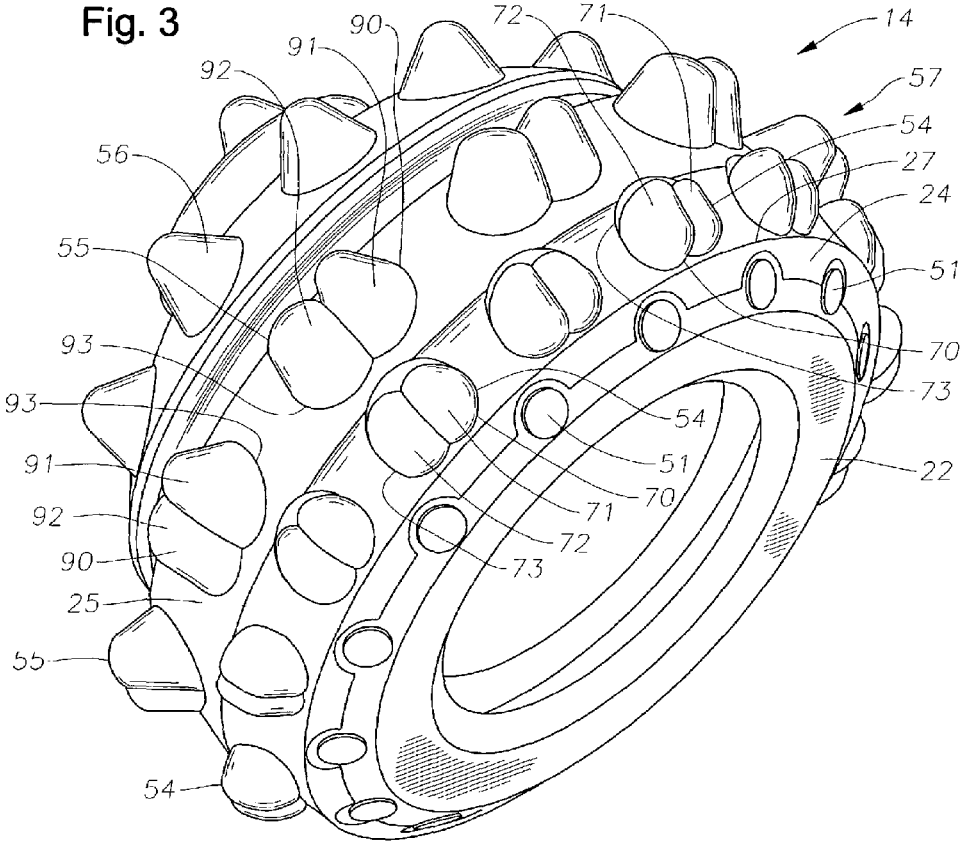
FIG. 3 is a perspective view of a rolling cone cutter of the bit in FIG. 1.

Cone cutter 14 is shown in greater detail in FIG. 3. As shown therein, each gage row cutter element 54 consists of a cluster 70 of inserts 71, 72 secured within a single aperture or socket 73 that is formed in surface 25, adjacent to shoulder 27. Similarly, each inner row cutter element 55 of first inner row 57 consist of a cluster 90 of inserts 91, 92, where inserts 91, 92 are secured within a single aperture or socket 93.

Figure 4:
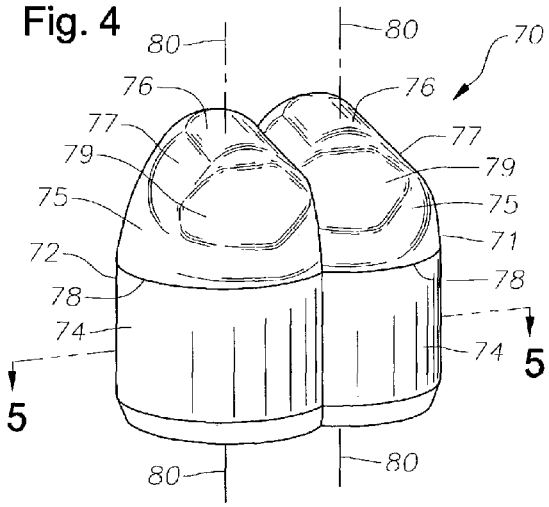
FIG. 4 is a perspective view of an insert cluster for use in the rolling cone cutter of FIG. 3, for example.

Referring to FIG. 4, gage row cluster 70 includes inserts 71, 72 that preferably are made of tungsten carbide or other wear-resistant materials. Inserts 71, 72 each includes a base portion 74 and a cutting portion 75 that extends from the base and intersects base 74 at intersection 78. Cutting portion 75 includes a rounded crest 76 and a side surface 79 extending between intersection 78 and crest 76. Side 79 includes flanks 77 extending upward to crest 76. Each insert 71, 72 include a central axis 80 and, in this embodiment, axes 80 of inserts 71, 72 are parallel to one another.

Inserts 71, 72 of insert cluster 70 may be made in any conventional manner such as the process generally known as hot isostatic pressing (HIP). HIP techniques are well known manufacturing methods that employ high pressure and high temperature to consolidate metal, ceramic, or composite powder to fabricate components in desired shapes. Information regarding HIP techniques useful in forming inserts described herein may be found in the book *Hot Isostatic Processing* by H. V. Atkinson and B. A. Rickinson, published by IOP Publishing Ptd., ©1991 (ISBN 0-7503-0073-6), the entire disclosure of which is hereby incorporated by this reference. In addition to HIP processes, the inserts and clusters described herein can be made using other conventional manufacturing processes, such as hot pressing, rapid omnidirectional compaction, vacuum sintering, or sinter-HIP.

Figure 5:
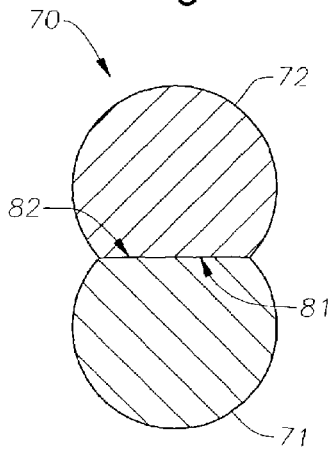
FIG. 5 is a cross-sectional view of the insert cluster shown in FIG. 4 taken along plane 5—5 shown in FIG. 4.

In one particular embodiment, insert 71, 72 are manufactured separately with each base 74 being cylindrical. Thereafter, one side of each insert 71, 72 is machined, as by grinding, to form a substantially flat interface surface for engaging a corresponding and generally flat interface surface on the other insert of the cluster 70. More specifically, referring to FIG. 5, cutter element cluster 70 and inserts 71, 72 are shown in cross section. As shown, a portion of the outer surface of inserts 71, 72 has been machined to create substantially planar interface surfaces 81, 82, respectively. Once machined and placed such that interface surfaces 81 and 82 engage one another, cutter element cluster 70 is then secured within aperture or socket 73, best shown in FIG. 6. Alternatively, rather than machining interface surfaces 81, 82, the inserts 71, 72 may be manufactured via HIP or similar techniques to form the desired interface surfaces 81, 82 in a single manufacturing step.

Figure 6:
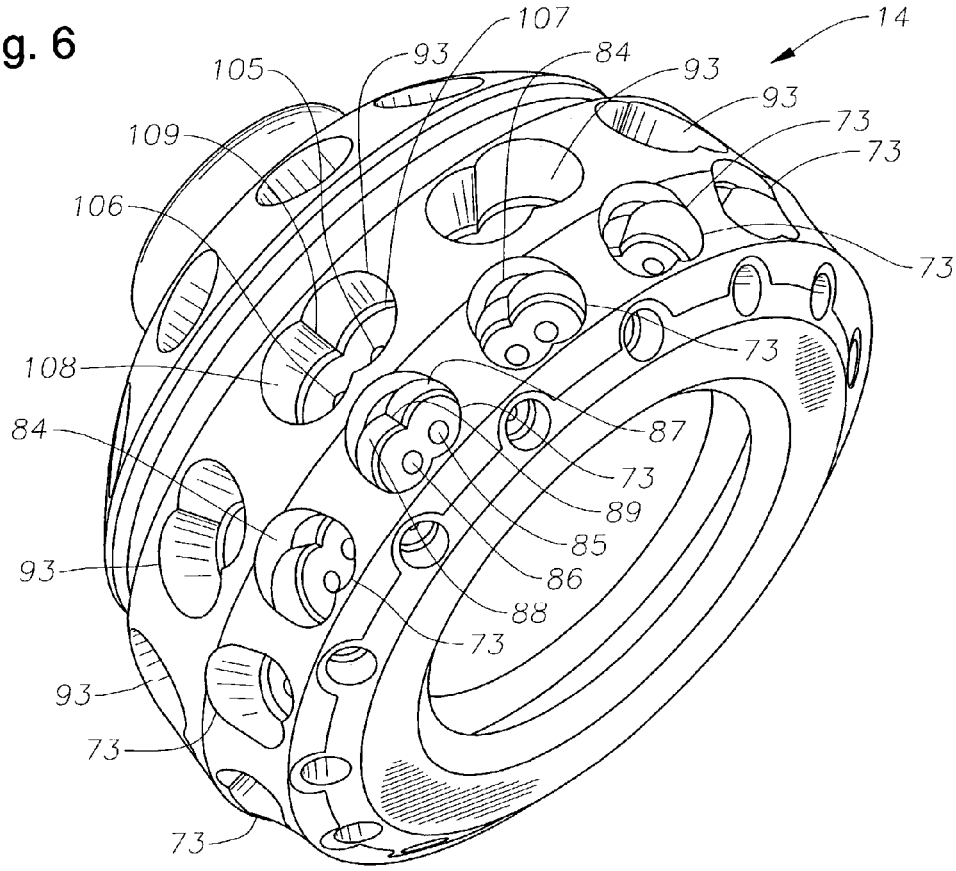
FIG. 6 is a perspective view of a rolling cone cutter useful in the drill bit of FIG. 1, the cone cutter shown in the stage of manufacture having apertures formed for receiving insert clusters.

Referring to FIG. 6, cone 14 is shown in the stage of manufacture prior to receiving cutter elements. Socket or aperture 73 is formed to receive and retain cluster 70 of gage inserts 70, 71 and is formed by boring intersecting bores 85, 86 that, in this embodiment, are formed such that their axes are substantially parallel to one another. Prior to forming bores 85, 86, a flat region 84 is milled on the cone surface to facilitate the subsequent drilling of bores 85, 86 in region 84. Aperture 73 may be described as a multilobed aperture having lobes 87, 88 that are separated by neck 89. As understood, the width of neck 89 is less than the diameter of each bore 85, 86. Bores 85, 86 are sized and the degree of overlap of the bores selected so that multilobed aperture 73 coincides with the footprint of insert cluster 70 so as to secure cluster 70 therein by interference fit. In this manner, multilobed aperture 73 is to be distinguished from an elongate slot or groove that has substantially the same width along the entire length of the slot. After intersecting bores 85, 86 are formed, it may be desirable to machine away any burrs that remain at neck 89, such step, where employed, having the effect of rounding off the edges otherwise formed at neck 89.

Once cone 14 is drilled to accept cutter element clusters 70, the inserts 71, 72 are pressed into the multilobed apertures 73, and retained therein by interference fit. Referring to FIGS. 3 and 4, inserts 71, 72 are embedded in cone 14 such that the base or barrel 74 is below the cone steel while cutting portion 75 extends above the cone. In the embodiment shown in FIGS. 3–6, inserts 71, 72 are formed such that interface surfaces 81, 82 extend substantially parallel to crests 76. Cutter element clusters 70 are press fit into sockets 73 in cone 14 with the crests 76 extending generally perpendicular to the circumferential direction of rotation of cone 14. As discussed below, in other embodiments, the orientation of inserts in a cluster may differ from that described with reference to FIGS. 3–6

Figure 7:
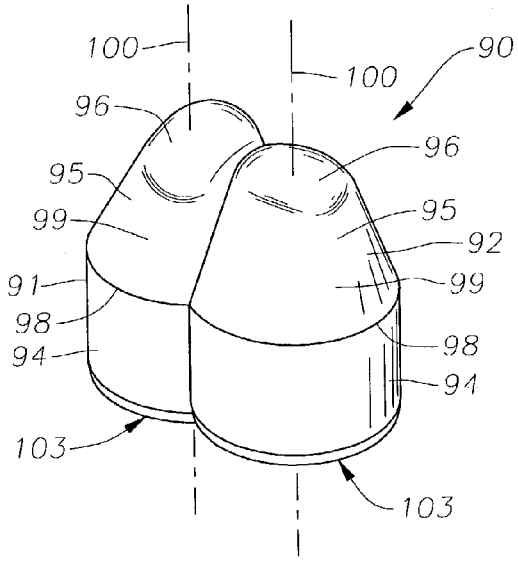
FIG. 7 is a perspective view of another insert cluster.

Referring now to FIGS. 3 and 7, cutter element cluster 90 of first inner row 57 is shown in more detail. Cutter element cluster 90 includes inserts 91 and 92, each of which includes a base or barrel portion 94, and a cutting portion 95 that intersects base portion 94 at intersection 98. Each cutting portion 95 includes a rounded crest 96 and side surface 99 that extends from intersection 98 to crest 96. In manufacturing cutter element cluster 90, insets 91, 92 are preferably formed as individual elements each of which having a generally cylindrical base. Prior to assembly into cone 14, one side of each insert 91, 92 is machined so as to form a substantially planar interface surface such that insert 91 and insert 92 contact one another in a substantially planar intersection extending from the bottom 103 of inserts 91, 92 to a location above intersection 98. Alternatively, inserts 91, 92 may be initially formed (through HIP or other technique) with the desired interface surfaces such that subsequent machining is not required. As shown in FIG. 7, inserts 91, 92 are placed in contact with one another in an orientation such that, in this embodiment, crests 96 of inserts 91, 92 are generally perpendicular to one another.

Referring again to FIG. 6, aperture 93 for receiving cluster 90 is formed by boring intersecting holes 105, 106. Because the holes 105, 106 intersect, but are not coaxial, aperture 93 is formed as a multilobed aperture 93 having neck portion 109 with lobes 107, 108 extending therefrom. Bores 105, 106 and the degree of overlap thereof are selected so as to coincide with the footprint of insert cluster 90 and to secure cluster 90 therein by interference fit. As best shown in FIG. 3, in this embodiment, cluster 90 is secured within cone 14 such that crest 96 of cutter element 91 extends substantially perpendicular to the direction of rotation of cone 14, while crest 96 of cutter element 92 extends generally in the direction of rotation of cone 14.

Figure 8:
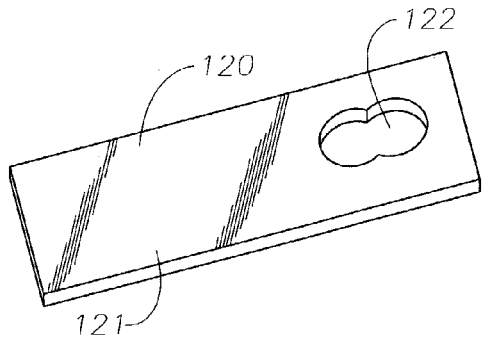
FIG. 8 is a perspective view of a handling template tool useful in inserting insert clusters into apertures formed in the rolling cone cutter.

In manufacturing cone 14 and, more particularly, when securing insert clusters 70, 90, for example, in the cone, it is helpful to employ a handling template configured to secure temporarily the inserts of each cluster in engagement with one another and to position the cluster above the multilobed aperture prior to press fitting or otherwise securing the cluster into the cone. More particularly, referring to FIG. 8, there is shown a simple handling template 120 including a handle 121 and a receiving aperture 122. Handling template 120 may be made of any of a variety of materials, including plastic or metal. Receiving aperture 122 is formed in template 120 to have substantially the same shape as the footprint of the cluster to be inserted into the multilobed aperture of cone 14. It will be understood that the receiving aperture 122 will be slightly larger than the footprint, aperture 122 being sized so as to retain the inserts in the aperture by friction. Once the cluster 70 is retained in receiving aperture 122, the cluster 70 is placed in alignment with multilobed aperture 73 in cone 14. Thereafter, a conventional press is employed to press fit cluster 70 into aperture 73, the press pushing inserts 71, 72 out of engagement with handling template 120 and into the cone 14. Other methods may be employed to properly position clusters of inserts above the multilobed aperture. Likewise, the insert cluster may be secured within the multilobed aperture by securing means other than interference fit, such as welding or brazing. In addition to securing the inserts within an aperture by techniques such as press fitting, brazing and welding, the inserts alternatively may be secured with adhesives. Suitable adhesives include anaerobic adhesives, such as Retaining Compound 675, Part number: 67541 as marketed by Loctite Corporation.

Employing a cluster of inserts as a cutter element in place of a single, one-piece insert offers the bit designer (and ultimately the driller) significant advantages over the use of conventional bits and cutter elements. More particularly, the use of insert clusters allows the materials used in forming the various inserts of the cluster to be particularly tailored to best perform and best withstand the type of cutting duty experienced by that portion of the cutter element where the insert is situated. For example, it is known that as a rolling cone cutter rotates within the borehole, different portions of a given insert will lead as the insert engages the formation and thereby be subjected to greater impact loading than a lagging or following portion of the same insert. With many conventional inserts, the entire cutter element was made of a single material, a material that of necessity was chosen as a compromise between the desired wear resistance or hardness and the necessary toughness. Likewise, certain conventional cutter elements include a portion that performs mainly side wall cutting, where a hard, wear resistant material is desirable, and another portion that performs more bottom hole cutting, where the requirement for toughness predominates over wear resistance. With the insert clusters described herein, the materials used in the different inserts in the cluster can be varied and selected to best meet the cutting demands of that particular insert.

Cemented tungsten carbide is a material formed of particular formulations of tungsten carbide and a cobalt binder (WC—Co) and has long been used as cutter elements due to the material's toughness and high wear resistance. Wear resistance can be determined by several ASTM standard test methods. It has been found that the ASTM B611 test correlates well with field performance in terms of relative insert wear life. It has further been found that the ASTM B771 test, which measures the fracture toughness (K1c) of cemented tungsten carbide material, correlates well with the insert breakage resistance in the field.

It is commonly known that the precise WC—Co composition can be varied to achieve a desired hardness and toughness. Usually, a carbide material with higher hardness indicates higher resistance to wear and also lower toughness or lower resistance to fracture. A carbide with higher fracture toughness normally has lower relative hardness and therefore lower resistance to wear. Therefore there is a trade-off in the material properties and grade selection.

It is understood that the wear resistance of a particular cemented tungsten carbide cobalt binder formulation is dependent upon the grain size of the tungsten carbide, as well as the percent, by weight, of cobalt that is mixed with the tungsten carbide. Although cobalt is the preferred binder metal, other binder metals, such as nickel and iron can be used advantageously. In general, for a particular weight percent of cobalt, the smaller the grain size of the tungsten carbide, the more wear resistant the material will be. Likewise, for a given grain size, the lower the weight percent of cobalt, the more wear resistant the material will be. However, another trait critical to the usefulness of a cutter element is its fracture toughness, or ability to withstand impact loading. In contrast to wear resistance, the fracture toughness of the material is increased with larger grain size tungsten carbide and greater percent weight of cobalt. Thus, fracture toughness and wear resistance tend to be inversely related. Grain size changes that increase the wear resistance of a given sample will decrease its fracture toughness, and vice versa.

As used herein to compare or claim physical characteristics (such as wear resistance or hardness) of different cutter element materials, the term "differs" or "different" means that the value or magnitude of the characteristic being compared varies by an amount that is greater than that resulting from accepted variances or tolerances normally associated with the manufacturing processes that are used to formulate the raw materials and to process and form those materials into a cutter element. Thus, materials selected so as to have the same nominal hardness or the same nominal wear resistance will not "differ," as that term has thus been defined, even though various samples of the material, if measured, would vary about the nominal value by a small amount.

There are today a number of commercially available cemented tungsten carbide grades that have differing, but in some cases overlapping, degrees of hardness, wear resistance, compressive strength and fracture toughness. Some of such grades are identified in U.S. Pat. No. 5,967,245, the entire disclosure of which is hereby incorporated by reference.

Referring again to FIG. 3, the materials from which inserts 91, 92 are made may differ. As cone 14 rotates within the borehole, insert 92 will engage the formation before insert 91. As such, insert 92 absorbs the impact loading first, relative to insert 91. Therefore, to provide enhanced durability, insert 92 may be made of a tougher and less brittle carbide material than insert 91.

In addition to offering the substantial advantages afforded by varying materials among the inserts in a cluster, employing insert clusters in rolling cone cutters allows great flexibility in providing the particularly shaped cutting portion that is desired at a given location in the cone cutter. It is known, for example, that the cutting action of an insert differs at different points in its cutting path as it enters, penetrates, and then leaves engagement with the formation material. Accordingly, one particular segment of an insert's cutting portion may see cutting duty that differs from another segment, such that it would be desirable to optimize the shape or configuration of the cutting portion in order to take the best advantage of the cutting duty seen by that segment. Traditional inserts and cutters limit the ability of the bit manufacturer to optimize the cutting portion of the insert to significant degrees. By contrast, the use of insert clusters described herein permits inserts having quite different cutting portions to be manufactured, contacted together to form a cluster, and thereafter inserted into the cone to provide a cutter element with the cutting surface that is believed to be particularly desirable. Thus, insert clusters having a great variety of shapes beyond those shown and specifically described herein may be employed advantageously.

Figure 9:
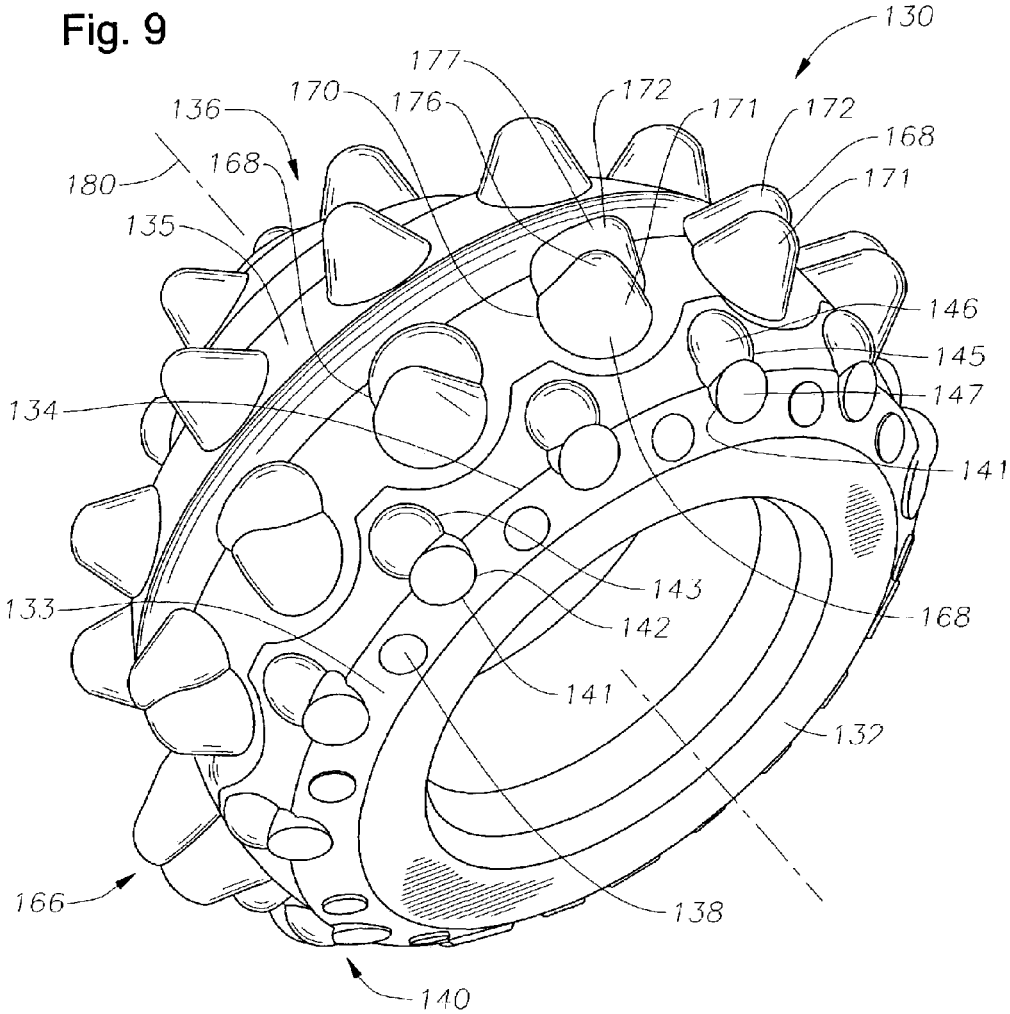
FIG. 9 is a perspective view of another rolling cone cutter incorporating insert clusters.

For example, referring now to FIG. 9, there is shown another rolling cone cutter having multilobed apertures for retaining clusters of cutting inserts. Cone 130 generally includes backface 132 adjacent to frustoconical heel surface 133. Cone 130 includes a generally conical surface 135 that intersects with heel surface 133 in a circumferential shoulder 134 and that extends to nose region 136. Retained in heel surface 133 are conventional cylindrical-shaped heel inserts 138. Cone 130 further includes a circumferential row 140 of multilobed apertures 141 retaining insert clusters 145 therein. Multilobed apertures 141 are formed by boring intersecting holes 142, 143 as previously described; however, in this embodiment, a first bore 142 is formed generally in heel surface 133, while the second intersecting bore 143 of multilobed aperture 141 is formed in conical surface 135. In this embodiment, bores 142, 143 are generally parallel, but they may likewise be skewed with respect to one another in order to achieve a particular orientation of the inserts or due to limitations in the cone steel available to support and retain the inserts.

Figure 10:
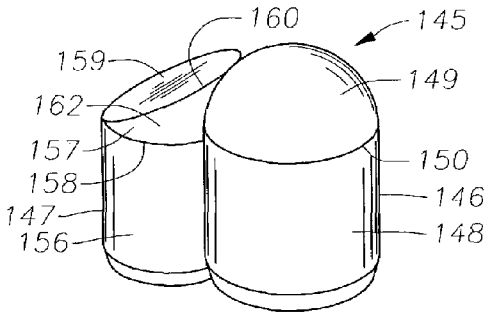
FIGS. 10–15 are perspective views of still other embodiments of insert clusters.

Insert cluster 145 includes inserts 146, 147 and is best shown in FIG. 10. As shown, insert 146 includes a base portion 148 and a generally domed-shaped cutting portion 149 extending therefrom and meeting base 148 at intersection 150. Insert 147 includes base 156 and a cutting portion 157 that meets base 156 at intersection 158. Cutting portion 157 of insert 147 includes a generally planar surface 159 and a curved cutting edge 160. The region 162 of cutting portion 157 is formed having a generally spherical radius that, in this embodiment, is substantially the same as the spherical radius of cutting portion 149 of insert 146.

In manufacturing insert cluster 145, each insert 146, 147 is preferably formed having a cylindrical base, with insert 146 formed with a domed-shaped cutting portion and insert 147 formed to have a generally planar and slanted surface on its cutting portion. Thereafter, each insert 146, 147, is machined so as to form a substantially planar interface surface (not shown in FIG. 10). The planar interface surface of inserts 146, 147 are thereafter placed in contact with one another and the cluster 145 is then press fit into the multilobed aperture 141 (FIG. 9). In this embodiment, the generally domed-shaped cutting portion 149 of insert 146 extends substantially to full-gage diameter. The relatively large and generally planar surface 159 of insert 147 (large compared to the diameter of conventional heel insert 138) provides substantial sidewall reaming capabilities and provides additional protection against erosion of the heel surface. As shown, multilobed aperture 141 extends into each of heel surface 133 and the generally conical surface 135, which is in contrast to many conventional rolling cone cutters in which an insert-retaining bore is formed in either one or the other surface. The inserts of cluster 145 may be made of the same or differing materials. For example, insert 147 which engages the sidewall of the borehole to a greater degree than insert 146, preferably is made of a harder, more wear resistant material than insert 146. Insert 146, which performs more bottom hole cutting and must endure more impact loading than insert 147 is preferably made of a tougher, but less wear resistant material than insert 147.

Referring again to FIG. 9, cone cutter 130 also includes a first inner row 166 of insert clusters 168 retained in multilobed apertures 170. Each cluster 168 includes a pair of inserts 171, 172 having cutting portions 174 extending above the cone steel and base portions (not shown) embedded in the cone and retained in multilobed apertures 170. The cutting portion 174 of inserts 171, 172 includes a crest 176, 177 respectively. As shown, inserts 171, 172 are positioned in the cone such that their respective crests 176, 177 extend generally perpendicular to one another. Further, the intersecting bores forming multilobed aperture 170 are not aligned so as to be co-planar with cone axis 180 in any plane. More particularly, the bores are offset slightly such that a plane passing through crest 176 of insert 171 and through cutter axis 180 does not bisect crest 177 of insert 172. Inserts 171, 172 of insert cluster 168 may be made of the same or similar materials or, to provide particular enhancements, may differ in material. More specifically, in one preferred embodiment, insert 171 is made of a material that is tougher, but less wear resistant, than insert 172. As cone cutter 130 rotates in the borehole, because insert 171 is further from the bit axis (closer to the back face of the cone) it will rotate at a velocity higher than insert 172 and thus will experience higher forces as it impacts the borehole bottom. Further, because crest 176 of insert 171 is oriented in a direction generally perpendicular to the direction of cone rotation, greater forces are applied by the formation to insert 171 than to insert 172 which presents a smaller cutting profile by virtue of its crest 176 being oriented generally in the direction of cone rotation. For these reasons, where differing materials are used for the inserts of cluster 168, insert 171 is preferably made of a tougher material, and insert 172 made of a harder, more wear resistant material.

Inserts in clusters may also include coatings comprising differing grades of super abrasives. Such super abrasives may be applied to the cutting surfaces of all or some of the inserts of the insert clusters. In many instances, improvements in wear resistance, bit life and durability may be achieved where only certain inserts in a cluster includes the super abrasive coating.

Super abrasives are significantly harder than cemented tungsten carbide. As used herein, the term "super abrasive" means a material having a hardness of at least 2,700 Knoop (kg/mm.sup.2). PCD grades have a hardness range of about 5,000–8,000 Knoop (kg/mm.sup.2) while PCBN grades have hardnesses which fall within the range of about 2,700–3,500 Knoop (kg/mm.sup.2). By way of comparison, conventional cemented tungsten carbide grades typically have a hardness of less than 1,500 Knoop (kg/mm.sup.2).

Certain methods of manufacturing cutter elements with PDC or PCBN coatings are well known. Examples of these methods are described, for example, in U.S. Pat. Nos. 5,766,394, 4,604,106, 4,629,373, 4,694,918 and 4,811,801, the disclosures of which are all incorporated herein by this reference.

Providing a specific example of employing super abrasives to various inserts in an insert cluster, reference is again made to cone 130 of FIG. 9. As shown therein, insert 147 may be made of a first grade of tungsten carbide and coated with a diamond coating to provide the desired wear resistance. At the same time, insert 146 may be made of a relatively tough tungsten carbide, and not have diamond coating, given that it must withstand more impact loading than insert 147. It is known that diamond coated inserts are susceptible to chipping and spalling of the diamond coating when subjected to repeated impact forces.

As another example, and referring still to FIG. 9, it may be desirable in certain applications to coat insert 172 with a diamond coating but employ no such coating on insert 171. Insert 171, as explained above, is made of a relatively tough grade of carbide to withstand the impact loads that it will experience. However, due to the smaller cutting profile and lower velocity, the diamond coating on insert 172 may survive the less severe impact loading that it experiences, and thereby provide a degree of wear resistance not otherwise possible if insert 172 had no super abrasive coating.

Figure 11:
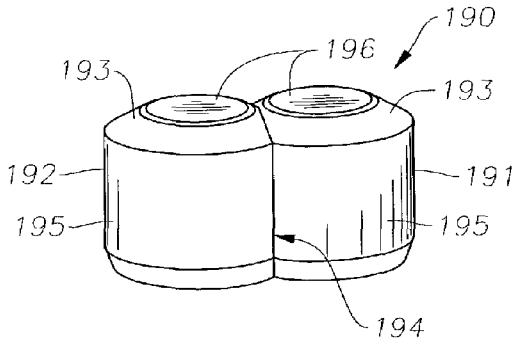

Depending upon the formation expected to be encountered and other considerations, insert clusters having two, three or more inserts may be formed and secured within multilobed apertures in a cone cutter. Further, the size, shape and extension of the inserts in the cutter element clusters may vary. Examples of certain of such clusters are shown in FIG. 11–14. Referring first to FIG. 11, insert cluster 190 is shown to include inserts 191, 192, each of which includes a base portion 195 and a cutting portion 193 having a generally flat top 196. Inserts 191, 192 include interface surfaces (machined or otherwise formed) that contact one another at a generally planar interface 194.

Figure 16:
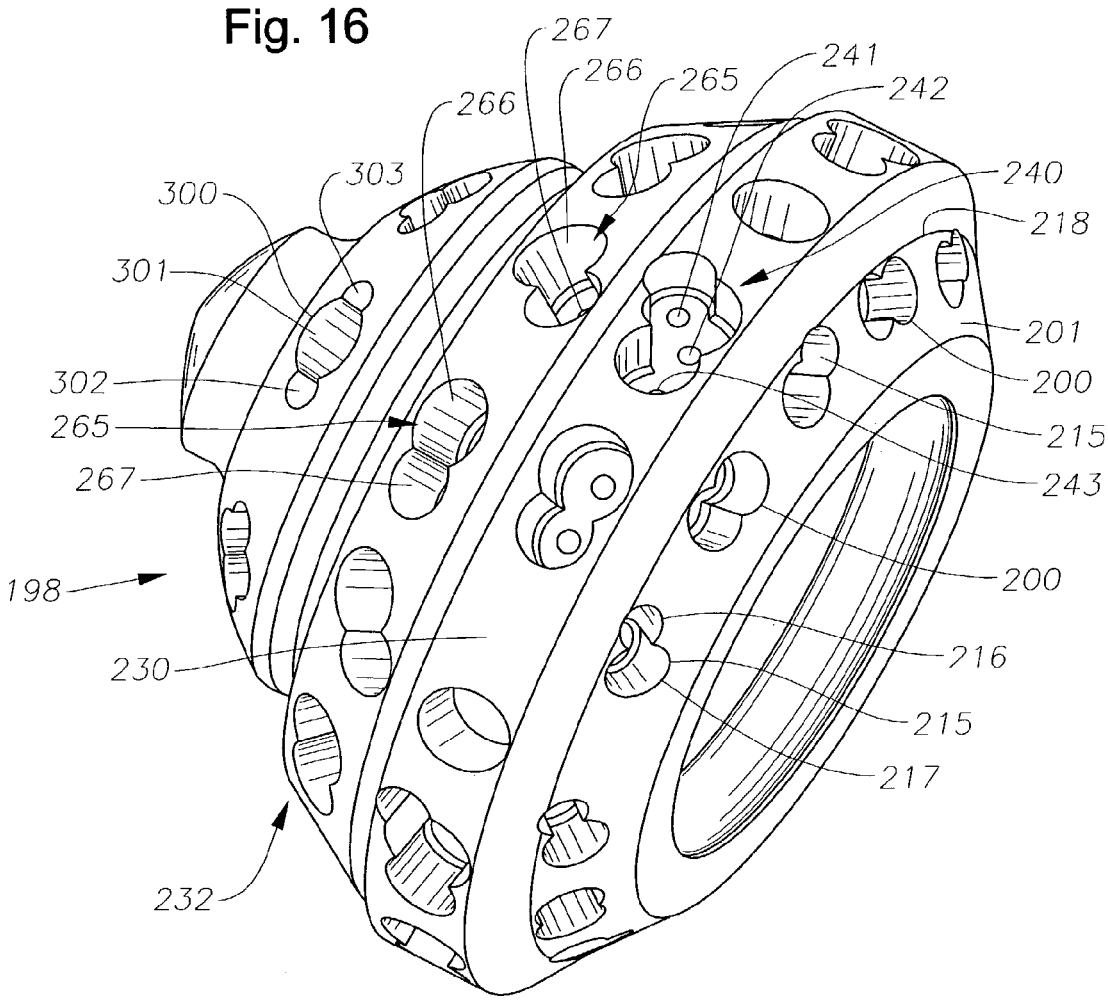
FIG. 16 is a perspective view, similar to FIG. 6, showing an alternative rolling cone cutter having apertures formed to receive insert clusters.

Referring momentarily to FIG. 16, a cone cutter 198 is shown including a plurality of circumferential rows of multilobed apertures that are formed by intersecting bores as previously described. Cone 198 includes multilobed apertures 200 for retaining insert clusters 190 (FIG. 11) in the heel surface 201.

Figure 12:
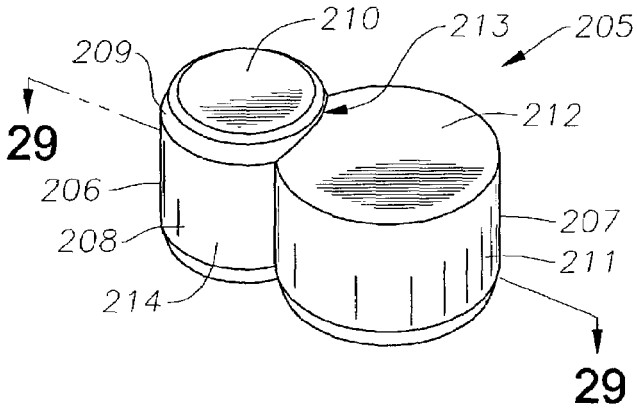
Figure 29:
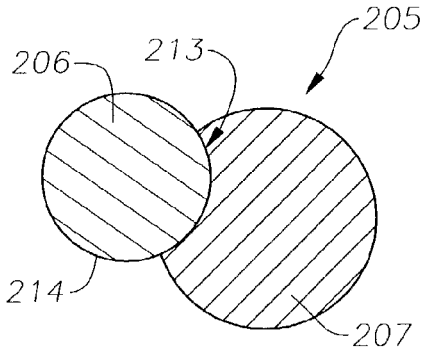
FIG. 29 is a cross sectional view of the insert in FIG. 12.

Referring now to FIGS. 12 and 29, an insert cluster 205 is shown to include inserts 206, 207. Insert 206 includes a base 208 and a cutting portion 209 having a generally planar upper surface 210. Base 208 is generally cylindrical and, in this embodiment, does not include a flat or planar interface surface.

Insert 207 includes a base portion 211 and a dome-shaped cutting surface 212, surface 212 having a relatively large radius of curvature in this particular embodiment. Insert 207 is manufactured as a cylindrical insert but includes a machined and curved interface recess 213 for receiving and engaging the outer surface 214 of insert 206, recess 213 being formed to have a radius substantially identical to the radius of insert 206. In this sense, insert 206 is nested within the recess 213 of insert 207 to form insert cluster 205. As shown in FIG. 12, in this particular embodiment, the insert 207 is formed from a cylindrical insert having a diameter that is larger than the diameter of insert 206. A cross sectional view of insert cluster 205 is shown in FIG. 29. Referring now to FIG. 16, insert cluster 205 may be disposed in multilobed apertures 215 which include a first bore 216 and a second intersecting bore 217, bore 217 being larger in diameter than bore 216. In this configuration, the relatively large spherical surface 212 of insert 207 provides substantial protection to heel surface 201 while the cutting portion 209 of insert 206 extends slightly beyond surface 212 of insert 207 and provides enhanced cutting action adjacent to circumferential shoulder to 218 between heel surface 201 and generally conical surface 230 of cone cutter 198. Nesting insert 206 within the cured interface 213 of insert 207 provides additional resistance to movement of insert 206 relative to insert 207 so as to decrease the likelihood of those inserts moving within or falling out of multilobed aperture 215.

Figure 13:
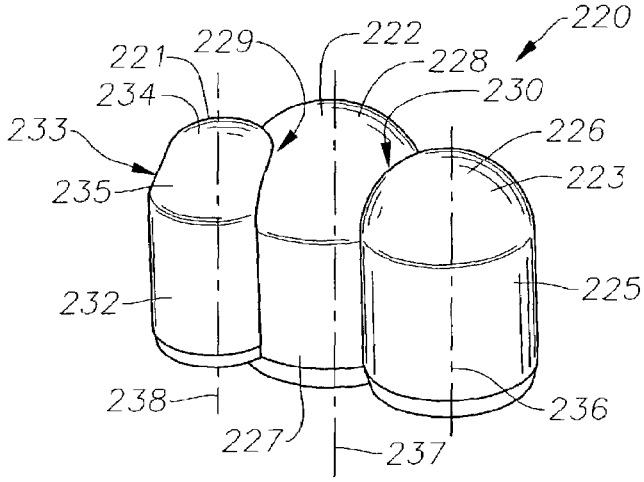

Referring now to FIG. 13, an insert cluster 220 including inserts 221, 222, 223 is shown. Insert 223 is substantially identical to insert 146 previously described with reference to FIG. 10 and has a substantially cylindrical base 225 and a generally domed-shaped cutting portion 226. Cutter element 221 includes a cylindrical base 232 and a cutting portion 233 having a generally rounded top 234 and a sloping, frusto-conical side surface 235. Insert 222 is formed from a larger diameter cylindrical insert and also, prior to machining, includes a cylindrical base 227 and domed-shaped cutting portion 228. Insert 222 includes two machined and curved interface recesses 229, 230 for receiving nested inserts 221, 223 respectively. Recesses 229, 230 are formed having a radius to match the radius of the nested insert. In this embodiment, inserts 221–223 of cluster 220 are not aligned with one another. More specifically, insert axis 238 of insert 221 is offset from the plane containing axes 236, 237 of inserts 223, 222, respectively. In this embodiment, cutting portion 233 extends to a greater height than the cutting portion of inserts 221, 222; however, insert cluster 220 may be formed from inserts all having the same extension length or height.

Referring again to FIG. 16, cutter element cluster 220 may be disposed in multilobed aperture 240 formed by intersecting bores 241, 242, 243 in cone surface 230. In this embodiment, bores 241–243 are formed generally parallel to one another; however, the axes of the bores are not co-planar but instead, bore 241 is offset from the plane formed by the axes of bores 242, 243.

Figure 14:
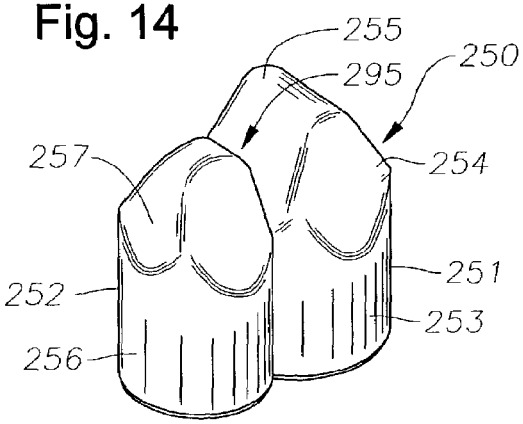

FIG. 14 shows still another embodiment of insert clusters that may be employed. Here, cluster 250 includes inserts 251 and 252 having differing extensions or heights. Cutter element 251 includes a base portion 253 and a cutting portion 254 that extends from the base to form crest 255. Insert 252 includes base 256 and cutting portion 257 but has a shorter extension length than insert 251 such that, upon assembly in a cone cutter, insert 251 will extend further above the cone steel. When originally formed, the diameter of insert 251 is larger than the diameter of insert 252. Cluster 250 further includes an insert interface where insert 251 contacts insert 252. Although the interface between inserts 251, 252 may be formed when the inserts are formed via a conventional manufacturing processes, it is believed that manufacturing advantages are present when inserts 251, 252 are first made in a generally cylindrical form and the interface then formed into one or both of the inserts, as by lapping or grinding, for example. The interface may comprise planar portions formed on each insert 251, 252 or, alternatively, may include a radiused recess in one of the inserts to correspond with the radius of the other insert. In either instance, the footprint of cluster 250 will include a dual-lobed cross-section having a neck portion at the interface. Referring once again to FIG. 16, cluster 250 may be secured within multilobed aperture 265. Multilobed aperture 265 is formed by forming intersecting bores 266, 267 in cone surface 230, bore 266 being formed with a larger diameter than bore 267. As shown in FIG. 16, inner row 232 for receiving and securing clusters 250 include multilobed apertures 265 that alternate, or otherwise vary, in orientation.

Figure 15:
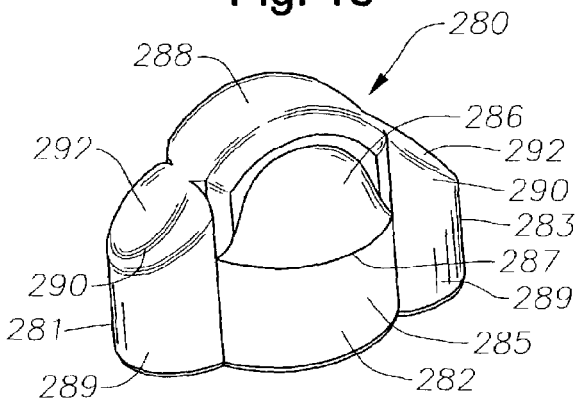

Another insert cluster comprising three inserts is shown in FIG. 15. As shown, insert cluster 280 includes inserts 281–283. Centrally positioned insert 282 is larger in diameter and height or extension than inserts 281, 283. Preferably, each insert 281–283 is originally formed having a cylindrical base and a cutting portion extending therefrom. Insert 282 includes base portion 285 and cutting portion 286 extending therefrom and intersecting base 285 at intersection 287. The cutting portion 286 includes a curved top surface 288. Inserts 281, 283 are substantially identical and each includes a base portion 289 and a cutting portion 290 extending therefrom. Cutting portions 290 include top cutting surfaces 292 that are curved and intersect curved top surface 288 of insert 282 in a smooth transition such that there is substantially no discontinuity between the cutting surfaces 292 and 288. As such, insert cluster 280 presents a generally continuous and smooth upper cutting surface as formed by the upper surfaces 288, 292 of inserts 281–283. By contrast, and referring again to FIG. 14, the upper cutting surface of insert 250 provided by the engaged insets 251, 252 includes a discontinuity or valley 295 between crests 255, 257 such that cluster 250 presents a more aggressive cutting structure than that provided by the insert cluster 280 of FIG. 15.

Referring to FIG. 16, cutter element cluster 280 may be disposed in multilobed aperture 300 formed by intersecting bores 301–303. Bores 301–303 include co-planar axes and are substantially parallel in this embodiment.

Figure 17:
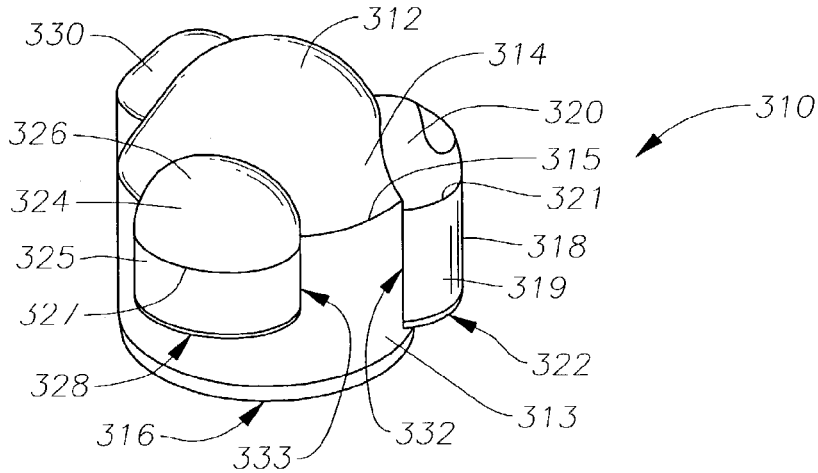
FIG. 17 is a perspective view of another insert cluster including inserts having differing lengths.

In the insert clusters described above, the inserts were positioned in the cluster and the multilobed apertures formed such that the bottoms of the inserts extended to the same depth within the cone steel. However, the embodiments described herein may be formed such that the bases of the inserts in the cluster extend to different depths within the cone steel. As described above, in certain cone designs, the space available for securing an insert in the cone steel is limited due, for example, to bores into the cone steel entering from other orientations and from other rows. However, multilobed apertures may be formed by intersecting bores that have differing depths and insert clusters employed that have inserts that extend to different depths in the cone steel. More specifically, referring to FIGS. 17 and 18, an insert cluster 310 is shown having a central insert 312 and peripheral inserts 318, 324 and 330. Central insert 312 includes a base 313 and a cutting portion 314 extending from the base at intersection 315. Insert 312 further includes a bottom surface 316. Similarly, peripheral insert 318 includes base 319, cutting portion 320 extending from intersection 321, and a bottom surface 322. Peripheral insert 324 includes base 325, a cutting portion 326 extending from intersection 327, and a bottom surface 328. Peripheral inserts 318, 324 contact central insert 312 at interfaces 332, 333, respectively. Not visible in FIG. 17 is the interface between insert 330 and insert 312. The interfaces 332, 333 are shown to be generally planar; however, cluster 310 may likewise be formed with peripheral inserts 318, 324, 330 retaining a substantially cylindrical shape, with central insert 312 being formed to include radiused recesses so that peripheral inserts 318, 324, 330 nest against insert 312 along the radiused interfaces.

As shown in FIG. 17, the extension length of peripheral inserts 318 and 324 differ from one another (and from central insert 312), insert 318 being longer than insert 324 (and both being shorter than central insert 312). Furthermore, inserts 318, 324 engage central insert 312 in a position such that bottom surface 322 of insert 318 is closer to bottom surface 316 of insert 312 than is bottom surface 328 of peripheral insert 324. This may be advantageous in situations where, as described above, a bore securing an insert in another row in the cone cutter prevents a peripheral insert having a length of insert 318 being placed where peripheral insert 324 is desired to be positioned. Accordingly, a shorter insert 324 and one extending a lesser depth into the cone steel is provided.

Figure 18:
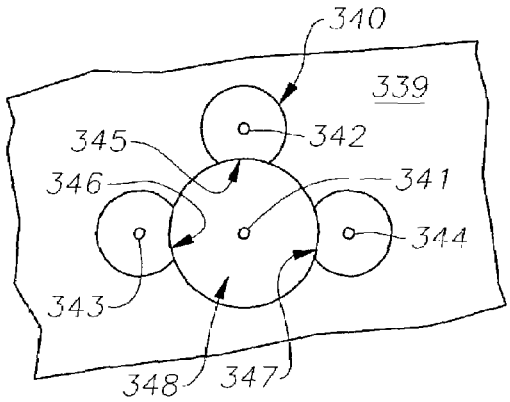
FIG. 18 is a partial plan view of a portion of a rolling cone cutter showing a multilobed aperture sized and configured for receiving the insert cluster of FIG. 17.

Referring now to FIG. 18, insert cluster 310 may be disposed in the multilobed aperture 340 formed in cone 339 by intersecting bores 341–344. As shown, central bore 341 has the largest diameter and is deeper than bores 342–344 that are provided to form the lobes that receive peripheral inserts 318, 324, 330. More particularly, bore 344 receives insert 318 and is formed to a depth greater than bore 343 that is provided for receiving peripheral insert 324. In this manner, multilobed aperture 340, in this embodiment, may also be described as having a non-planar, multilevel bottom surface 348.

Multilobed apertures for receiving and retaining insert clusters may be formed by intersecting bores that are substantially perpendicular to the cone surface at the location at which they are formed, or at other angles. Further, the intersecting bores forming the multilobed apertures may be parallel to one another or skewed with respect to one another. For example, referring to FIG. 19, a multilobed aperture is shown in cross-section formed in cone steel 350. Surface 351 represents the outer surface of the cone. As shown, bores 352, 353 are formed to differing depths into cone steel 350 so as to form multilobed aperture 354 that includes a multilevel bottom surface 356 having a first surface 357 and a lower, second surface 358. Bores 352 and 353, in this embodiment, are formed substantially parallel to one another and formed in a direction substantially perpendicular to cone surface 351.

Figure 20:
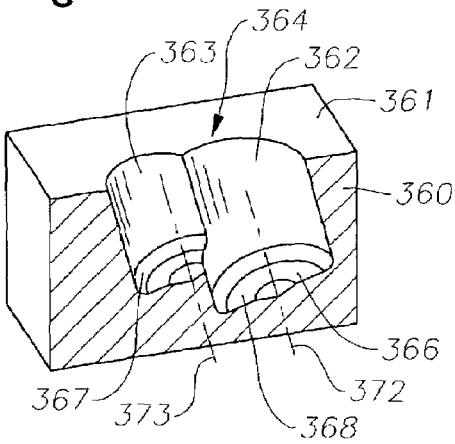

Referring to FIG. 20, a portion of rolling cone 360 having outer surface 361 is shown including bores 362 and 363 that are formed to intersect one another and to extend to differing depths within the cone steel 360. Bores 362, 363 thus form multilobed aperture 364 having a non-planar, multilevel bottom surface 366 formed by multi-levels 367 and 368 as best understood with reference to axes 372, 373. In this embodiment, bores 362, 363 are formed substantially parallel to one another, but extend at an angle, and thus are not perpendicular to, cone surface 361.

Figure 19:
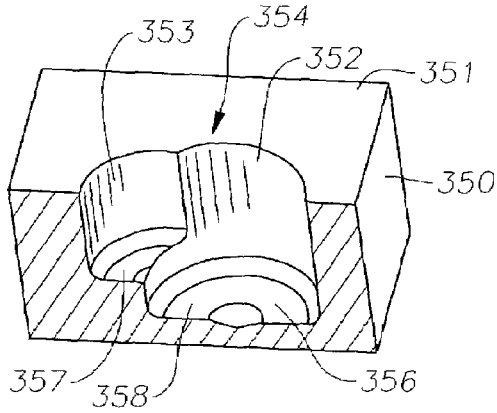
FIGS. 19–21 are perspective views of a portion of a rolling cone cutter taken in cross-section and showing intersecting bores forming a multilobed aperture for retaining insert clusters.
Figure 21:
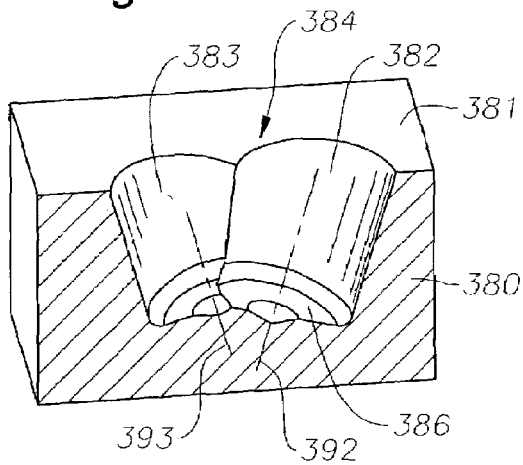

In FIG. 21, intersecting bores 382, 383 are formed into the surface 381 of cone 380 to form a multilobed aperture 384. In this embodiment, multilobed aperture 384 includes a non-planar bottom surface 386. Bores 382, 383 include central axes 392, 393, respectively, and bores 382, 383 extend into the cone steel 380 at angles that are neither parallel to one another nor perpendicular to the cone surface 381. Varying the angles of the intersecting bores, as illustrated in FIGS. 19–21, provide an additional means for securing insert clusters in locations where limitations would otherwise prevent forming the aperture with parallel bores. Insert clusters may be secured within multilobed apertures such as aperture 384 by welding or brazing the inserts once they are inserted into the aperture.

Figure 22:
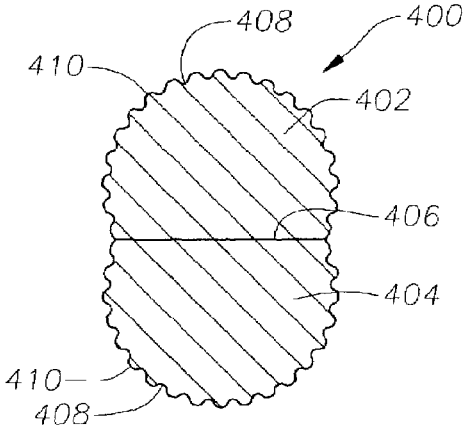
FIG. 22 is a cross-sectional view of an insert cluster where the inserts in the cluster include alternating ridges and grooves along the outer surface of the cluster.

In placing individual inserts in apertures and retaining them by interference fit, it is known to provide ridged or grooved surfaces along the peripheral surface of the insert body to increase the forces retaining the insert in the aperture. Referring to FIG. 22, a cluster 400 of inserts is shown to include insert 402, 404. Inserts 402, 404 include machined and substantially planar surfaces that contact at interface 406. In this particular embodiment, the outer surfaces of the base or barrel portion of inserts 402, 404 include a pattern of alternating and parallel longitudinal grooves 408 and ridges 410. Insert cluster 400 may be secure in a multilobed aperture such as aperture 73 shown in FIG. 6.

In addition to the generally planar interface for inserts in a cluster and the interface in which a generally cylindrical insert nests within a radiused recess of another insert, other interfaces for insert clusters may be employed. For example, referring to FIG. 23, an insert cluster 420 is shown in cross section to consist of insert 422, 424 which engage one another at interface 426. As shown, inserts 422, 424 are formed with interlocking or intermeshing ridges and grooves forming an interface 426 that prevents sliding motion of insert 422 relative to insert 424. In this embodiment, inserts 422, 424 are preferably manufactured as having cylindrical base portions. Thereafter, a substantially planar surface is formed on each insert and the grooves and ridges thereafter formed therein. In this way, insert 422 includes an interface surface 428 having intermeshing extensions 429 that, when insert 422 engages insert 424, are received in correspondingly shaped intermeshing recesses 432 formed in interface surface 430.

Figure 24:
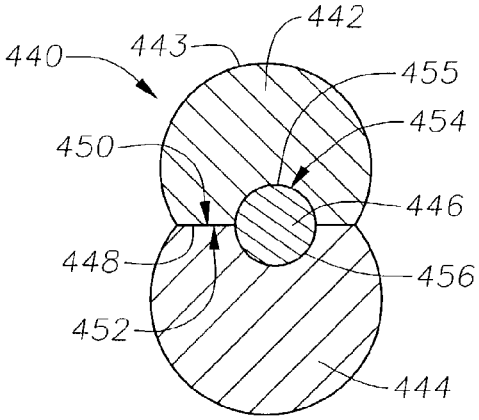
FIG. 24 is a cross-sectional view of another insert cluster including a locking insert at the interface surface.

Referring to FIG. 24, another interface is shown that enhances the stability of inserts in an insert cluster and that prevents movement of the inserts within the cluster when the cluster is inserted into an aperture in the cone steel. As shown in FIG. 24, insert cluster 440 includes inserts 442, 444, 446. Insert cluster 440 is configured to be retained in a cone cutter having a two-lobed aperture (such as aperture 240 in FIG. 16). Insert cluster 440 includes an interface 448 that includes interface surface 450 of insert 442, surface 452 of insert 444, and surface 454 of insert 446. As understood from FIG. 24, interface surface 454 is generally cylindrical. Interface surfaces 450, 452 each include a pair of generally planar surfaces with a recessed radiused surface 455, 456, respectively, disposed between the generally planar surfaces. Surfaces 455, 456 have substantially the same radius as cylindrical surface 454 of insert 446. When inserts 442, 444, 446 are placed in engagement with one another into cluster 440 as shown in FIG. 24, insert 446 acts to prevent sliding motion of inserts 442, 444 with respect to one another and to lock inserts 442, 444, 446 together.

Figure 23:
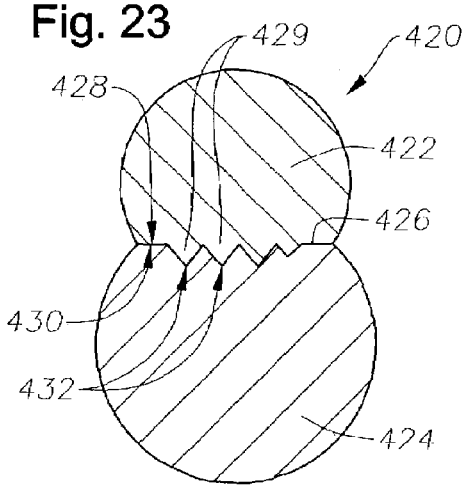
FIG. 23 is a cross-sectional view of another insert cluster where the inserts in the cluster include intermeshing extensions at the interface between the inserts.

In addition to intermeshing extensions as shown in FIG. 23 and locking inserts disposed between other engaging inserts, such as shown in FIG. 24, other means may be provided to assist in preventing sliding or rotational movement of inserts within clusters. For example, referring to FIGS. 5 and 24, interface surfaces 81, 82 (FIG. 5) and surfaces 450, 452 (FIG. 24) may be scored, grooved or otherwise roughened or made irregular so as to prevent relative sliding motion between the inserts. Likewise, as previously described with respect to FIG. 22, to enhance the forces retaining an insert cluster in a multilobed aperture, the outer surfaces of the insert in the cluster (those surfaces engaging the cone steel) may be scored, ridged, grooved or otherwise roughened).

Figure 25:
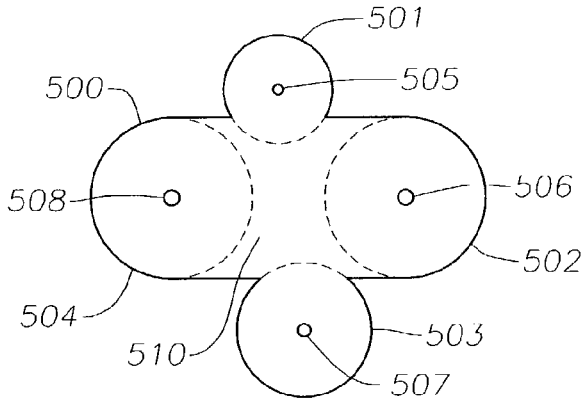
FIGS. 25, 26 are plan views of a portion of a rolling cone cutter showing further multilobed apertures formed from a pattern of spaced-apart bores.
Figure 26:
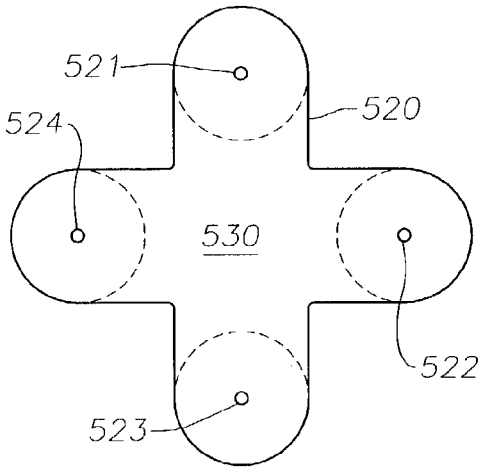

In addition to the method of forming intersecting bores to create a multilobed aperture, insert clusters may likewise be disposed and retained in multilobed apertures that are formed from multiple non-intersecting bores that are, after being formed, milled or otherwise machined in order to form the desired multilobed aperture. For example, referring first to FIG. 25, a multilobed aperture 500 is shown having four lobes 501–504 defining multilobed aperture 500. Bores of pre-selected diameter are first formed in the cone steel at bore centers 505–508. Thereafter, using a mill cutting tool, the region 510 within the perimeter of multilobed aperture 500 and bounded by the portion of bores 505–508 shown in phantom is removed. Multilobed apertures in a variety of shapes and configurations may be employed with this method. For example, referring to FIG. 26, a cruciform shaped four-lobed aperture 520 may be formed by boring non-intersecting bores 521–524, with the region 530 between such bores and within aperture 520 thereafter removed by a mill cutting tool or other means. Thereafter, insert clusters having a cross-sectional footprint generally matching that of aperture 520 may be press fit or otherwise secured within multilobed aperture 520.

As described above, it is believed that substantial improvements in drilling apparatus and methods for manufacturing such apparatus are provided by forming multilobed apertures in the cutter and securing a plurality of inserts as a cluster into the multilobed aperture. In addition to providing greater surface area for inserts, combining relatively small inserts into a cluster to provide the larger cutting surface area that is desired is substantially less costly to manufacture than a single, larger insert having the same cutting area as the cluster of smaller inserts. Nevertheless, manufacturing techniques have advanced such that multilobed inserts having non-cylindrical base portions may be manufactured and secured in non-cylindrical, multilobed apertures and so as to provide certain advantages over conventional cylindrical inserts.

Figure 27:
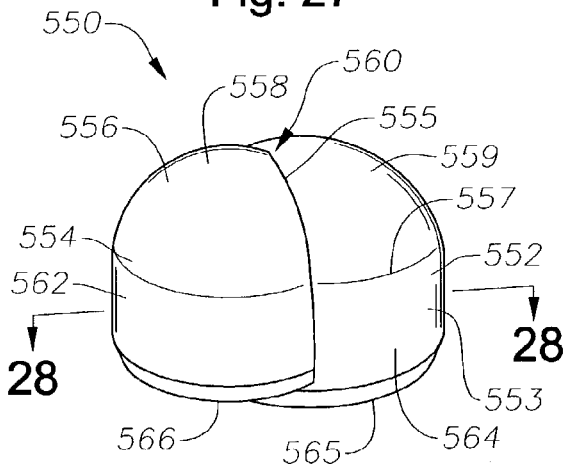
FIG. 27 is a perspective view of a multilobed insert for insertion into a multilobed aperture in a cutter.
Figure 28:
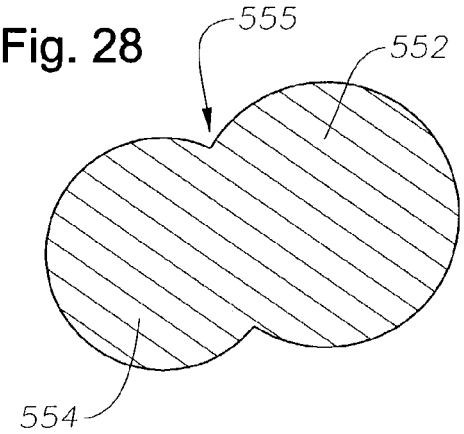
FIG. 28 is a cross sectional view of the insert shown in FIG. 27.

A multilobed insert 550 is shown in FIGS. 27 and 28. Insert 550 includes a pair of lobe portions 552, 554 that differ in size and that extend in opposite directions from a narrowed neck region 555. Insert 550 includes a base portion 553 and a cutting portion 556 extending from and intersecting the base at intersection 557. Cutting portion 556 includes two raised, partial dome-shaped surfaces 558, 559 and a valley 560 disposed therebetween generally in the region of neck portion 555. Base 553 includes two partial cylindrical surfaces 562, 564 that intersect at neck 555. The bottom surface of base portion 553 is a multilevel surface including generally planar and spaced apart surfaces 565, 566. As shown in FIG. 28, base portion 553 is noncylindrical and thus has a noncircular, and multilobed cross section. Insert 550 with its noncylindrical base portion may be formed by a conventional manufacturing technique, such as HIP, and thereafter press fit or otherwise secured within a two-lobed aperture, such as aperture 354 shown in FIG. 19, for example.

A multilobed insert such as insert 550 may be desirable in instances where limitations within the cone steel will not permit a single, large bore otherwise required to support a conventional insert having the desired surface cutting area. At the same time, forming insert 550 in a multilobed configuration and retaining it in a correspondingly shaped multilobed aperture formed, for example, by intersecting bores of different diameters and depths, will secure the insert 550 in the cone and prevent rotation or movement thereof. Also, manufacturing the socket by the technique of using intersecting bores to create the multi lobes is more efficient and less difficult than trying to machine or mill a socket to have an elongate, slot-shaped socket of substantially uniform width, such as that suggested in the aforementioned U.S. Pat. No. 5,421,423.

The insert clusters described herein have application in drill bits beyond their use in rolling cone cutters. For example, the insert clusters described herein may be retained in apertures formed in the cutting surfaces of fixed blade or "drag bits." Likewise, insert clusters may be secured in apertures formed in the body of a drill bit about or in close proximity to nozzles, lubricant reservoirs or other bit features deserving of additional protection from wear and erosion. Referring to FIG. 1, insert clusters 190 previously described with reference to FIG. 11 are shown press fit in multilobed apertures 602 that are formed adjacent to lubricant reservoirs 28. Similarly, insert clusters 190 are secured in apertures 602 formed in the shirttail portion of bit legs 12 to provide protection from wear.

While various preferred embodiments of the invention have been showed and described, modifications thereof can be made by one skilled in the art without departing from the spirit and teachings of the invention. The embodiments herein are exemplary only, and are not limiting. Many variations and modifications of the apparatus and methods disclosed herein are possible and within the scope of the invention. Accordingly, the scope of protection is not limited by the description set out above, but is only limited by the claims which follow, that scope including all equivalents of the subject matter of the claims.

What is claimed is:

1. A drill bit for drilling a borehole through earthen formations comprising:

a bit body having a bit axis;

at least one rolling cone cutter mounted on said bit body for rotation about a cone axis;

an aperture in said cone cutter, said aperture having a non-circular shape;

a cluster of cutting inserts mounted in said aperture.

2. The drill bit of claim 1 wherein said aperture includes a plurality of lobes.

3. The drill bit of claim 2 wherein said aperture includes a bottom surface and wherein said bottom surface is multi-level.

4. The drill bit of claim 2 wherein said aperture includes at least one neck portion.

5. The drill bit of claim 2 wherein said aperture includes at least three lobes.

6. The drill bit of claim 2 wherein said aperture includes lobes of at least two different sizes.

7. The drill bit of claim 6 wherein said inserts of said cluster extend into said rolling cone cutter to different depths.

8. The drill bit of claim 2 wherein said cluster of cutting inserts are retained in said aperture by interference fit.

9. The drill bit of claim 1 wherein said cluster includes inserts that extend to at least two different heights above the cone surface.

10. The drill bit of claim 1 wherein said cluster includes inserts having cutting surfaces that differ in shape.

11. The drill bit of claim 1 wherein said cluster includes at least one insert having a machined interface surface engaging another of said inserts of said cluster.

12. The drill bit of claim 11 wherein said cluster includes at least two inserts having machined interfaces, and wherein said interfaces contact one another when said inserts are secured in said aperture.

13. The drill bit of claim 11 wherein said machined interface comprises an arcuate surface.

14. The drill bit of claim 11 wherein said machined interface comprises a substantially planar surface.

15. The drill bit of claim 14 wherein said machined interface comprises a series of alternating ridges and troughs.

16. The drill bit of claim 1 further comprising:

a first circumferential row of insert clusters mounted in said cone cutter;

a second circumferential row of insert clusters mounted in said cone cutter and spaced apart from said first row;

wherein said insert clusters in said first row have cutting portions that differ from the cutting portions of said insert clusters in said second row.

17. The drill bit of claim 16 wherein said insert clusters in said first row include at least one insert having a cutting portion with a generally flat surface, and said insert clusters in said second row include at least one insert having a cutting portion with an elongate crest.

18. The drill bit of claim 17 wherein said insert clusters in said second row include at least two inserts having a cutting portion with an elongate crest, and wherein said crests are substantially parallel.

19. The drill bit of claim 17 wherein said insert clusters in said second row include at least two inserts having a cutting portion with an elongate crest, and wherein said crests are skewed with respect to one another.

20. The drill bit of claim 17 wherein said cone cutter includes a heel portion, a nose portion, and a generally conical portion extending between said heel and said nose portion, and wherein insert having a cutting portion with a generally flat surface extends from said heel surface.

21. The drill bit of claim 1 wherein said cluster includes a first insert made of a material having a first hardness and a second insert made of a material having a second hardness that differs from said first hardness.

22. The drill bit of claim 1 wherein at least one of said inserts in said cluster is made of a material that differs from the material of other of said inserts in said cluster.

23. The drill bit of claim 22 wherein at least one of said inserts in said cluster includes a super abrasive on a cutting surface.

24. The drill bit of claim 1 wherein said cluster of cutting inserts are adhesively retained in said aperture.

25. A drill bit for drilling a borehole through earthen formations comprising:

a bit body having a bit axis;

at least one rolling cone cutter mounted on said bit body for rotation about a cone axis;

a circumferential row of apertures in said cone cutter, said apertures including at least one multilobed aperture;

a cutter element secured in said multilobed aperture wherein said cutter element is a cluster of inserts retained together in said multilobed aperture.

26. The drill bit of claim 25 wherein said cluster of inserts includes at least two inserts having diameters that differ.

27. The drill bit of claim 25 wherein said cluster includes at least a first and second insert having a cutting portion with a crest, and wherein said crests of said cutting portions are generally parallel.

28. The drill bit of claim 25 wherein said cluster includes at least a first and second insert having a cutting portion with a crest, and wherein said crests of said cutting portions are generally perpendicular.

29. The drill bit of claim 25 wherein said cluster includes at least a first and second insert having cutting portions that extend to different lengths above the aperture.

30. The drill bit of claim 29 wherein said first and second inserts have base portions that differ in length retained in said aperture.

31. The drill bit of claim 25 wherein said cone cutter includes a heel surface and an adjacent generally conical surface and a circumferential shoulder therebetween, wherein said multilobed aperture is formed partially in said heel surface and partially in said generally conical surface.

32. The drill bit of claim 31 wherein said cluster includes a first insert and a second insert, said first insert including a cutting portion having a generally planar surface extending from said heel surface and said second insert including a cutting portion extending from said generally conical surface.

33. The drill bit of claim 31 wherein said aperture includes first and second intersecting bores.

34. The drill bit of claim 33 wherein said first and second intersecting bores are skewed relative to each other.

35. The drill bit of claim 25 wherein said multilobed aperture includes at least three intersecting bores, wherein said intersecting bores have axes that do not all fall within the same plane.

36. The drill bit of claim 25 wherein said aperture includes a multilevel bottom surface.

37. The drill bit of claim 36 wherein said cluster includes at least two inserts having base portions of different lengths retained in said aperture.

38. The drill bit of claim 25 wherein said aperture includes a first and a second intersecting bore, and wherein said first and second bores are skewed relative to one another.

39. The drill bit of claim 25 wherein said aperture includes a first and a second bore formed into a surface of said cone cutter, and wherein at least said first bore is not perpendicular with respect to said cone surface.

40. The drill bit of claim 25 wherein said cluster of inserts forms a cutting surface having at least two peaks separated by a valley.

41. The drill bit of claim 25 wherein said cluster of inserts forms a cutting surface free from discontinuities and extending across all of said inserts.

42. The drill bit of claim 25 wherein said inserts of said cluster include cutting surfaces having material properties that differ.

43. The drill bit of claim 42 wherein a first insert of said cluster has a cutting surface having a hardness greater than the hardness of a cutting surface of a second insert of said cluster.

44. The drill bit of claim 42 wherein at least one, but not all, of said inserts in said cluster include a super abrasive.

45. A drill bit for drilling a borehole through earthen formations comprising:

a bit body having a bit axis;

at least one rolling cone cutter mounted on said bit body for rotation about a cone axis;

a circumferential row of apertures in said cone cutter, said apertures including at least one multilobed aperture;

a cutter element secured in said multilobed aperture wherein said multilobed aperture includes a neck portion between at least two lobes of said aperture, and wherein said cutter element is a single cutting insert having a non-cylindrical shaped base portion, said base portion filling said at least two lobes of said aperture.

46. A drill bit for drilling a borehole through earthen formations comprising:

a bit body having a bit axis;

an aperture with a non-circular shape formed in said bit body;

a cluster of cutting inserts mounted in said aperture.

47. The drill bit of claim 46 wherein said aperture includes a plurality of lobes.

48. A drill bit for drilling a borehole through earthen formation comprising:

a bit body having a bit axis;

at least one rolling cone cutter mounted on said bit body and adapted for rotation about a cone axis;

a non-circular aperture in said cone cutter; and a plurality of cutting inserts mounted in said aperture.

49. The drill bit of claim 48 wherein said plurality of cutting inserts form a cluster having a multilobed cross-section.

50. The drill bit of claim 49 wherein said inserts of said cluster extend into said aperture to different depths.

51. The drill bit of claim 49 wherein said cluster includes inserts that extend to at least two different heights above the cone surface.

52. The drill bit of claim 49 wherein said cluster includes inserts having cutting surfaces that differ in shape.

53. The drill bit of claim 48 wherein said aperture is a multilobed aperture.

54. The drill bit of claim 53 wherein said multilobed aperture comprises lobes of at least two different sizes.

55. The drill bit of claim 48 wherein said aperture includes a bottom surface and wherein said bottom surface is multi-leveled.

56. The drill bit of claim 48 wherein said plurality of cutting inserts includes inserts having cutting surfaces that differ in shape, and wherein said aperture is multilobed.

57. A drill bit for drilling a borehole through earthen formation, comprising:

a bit body;

at least one rolling cone cutter mounted on said bit body for rotation about a cone axis, said cone cutter having an outer surface;

a first bore into said outer surface;

a second bore into said outer surface, said second bore intersecting with said first bore and forming a multi-lobed aperture in said outer surface of said cutter; and a cutter element secured in said multilobed aperture, said cutter element substantially filling said first bore and said second bore.

58. The drill bit of claim 57 wherein said cutter element comprises a plurality of cutting inserts press fit into said multilobed aperture.

59. The drill bit of claim 57 wherein said first and second bores differ in diameter.

60. The drill bit of claim 57 wherein said first and second bores extend into said cone to different depths.

61. The drill bit of claim 57 wherein said cutter element comprises a plurality of cutting inserts, and includes inserts that extend to at least two different heights above said outer surface of said cone.

62. The drill bit of claim 57 wherein said cutter element comprises a plurality of cutting inserts, and includes inserts having cutting surfaces that differ in shape.

* * * * *